US006331373B1

(12) United States Patent
Kuramoto et al.

(10) Patent No.: US 6,331,373 B1
(45) **Date of Patent: *Dec. 18, 2001**

(54) DEVELOPER FOR ELECTROSTATIC IMAGE

(75) Inventors: Shigefumi Kuramoto; Yasuhiro Sakai; Hayato Ikeda, all of Osaka; Nobuyuki Ando, Nara, all of (JP)

(73) Assignee: Nippon Shokubai Co., Ltd., Osaka-fu (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/592,112

(22) Filed: Jan. 26, 1996

(30) Foreign Application Priority Data

Jan. 26, 1995 (JP) ..... 7-010992
Jan. 11, 1996 (JP) ..... 8-003414
Jan. 11, 1996 (JP) ..... 8-003415

(51) Int. Cl.[7] ..... G03G 9/097
(52) U.S. Cl. ..... 430/110; 430/106; 430/111
(58) Field of Search ..... 430/106, 106.6, 430/109, 108, 110

(56) References Cited

U.S. PATENT DOCUMENTS 4,758,491 * 7/1988 Alexandrovich et al. ..... 430/109
5,429,901 * 7/1995 Muto et al. ..... 430/110
5,567,561 * 10/1996 Yoshikawa et al. ..... 430/108

FOREIGN PATENT DOCUMENTS 52-135739 11/1977 (JP) .
62159152 7/1987 (JP) .
63-40167 2/1988 (JP) .
63-101854 5/1988 (JP) .
63-101855 5/1988 (JP) .
63-36499 7/1988 (JP) .
63-244056 10/1988 (JP) .
1106073 4/1989 (JP) .
1204059 8/1989 (JP) .
1237557 9/1989 (JP) .
4198942 7/1992 (JP) .

* cited by examiner

*Primary Examiner*—John Goodrow
(74) *Attorney, Agent, or Firm*—Selitto, Behr & Kim

(57) ABSTRACT

An electrostatic image developer which has an improved charge retaining ratio is disclosed. The developer comprises toner particles comprising (a) a binding resin and (b) a coloring agent and having a mean particle diameter of not more than 25 $\mu$m, and (c) organic-inorganic composite particles attached or fixed to the surface or the proximity of surface of said toner particles. The composite particle contains an organic polymer framework and a polysiloxane framework, the polysiloxane framework having in the molecule thereof an organosilicon which has a silicon atom to which at least one carbon atom in said organic polymer framework combined directly, the organic-inorganic composite particles having $SiO_2$ as a component of said polysiloxane framework at a content in the range of 10 to 90% by weight. The composite particles have a mean particle diameter in the range of 0.01 to 5 $\mu$m. The mixing ratio of (b) the coloring agent to (a) the binding resin in the toner particles in 20 to 2 parts by weight of (b) to 80 to 98 parts by weight of (a), as the total amount of (a) and (b) is 100 parts. The mixing ratio of the organic-inorganic composite particles to the toner particles is 0.01 to 20 parts by weight of the composite particles to 100 parts by weight of the toner particles.

10 Claims, 4 Drawing Sheets

DEVELOPER FOR ELECTROSTATIC IMAGE

BACKGROUND OF THE INVENTION

1. Field of the Invention

This invention relates to a developer for electrostatic images. More particularly, this invention relates to an electrostatic image developer which exhibits properties such as charge stability and fluidity at improved levels.

2. Prior Art

The electrophotography produces a visible image by forming an electrostatic image on the surface of a photoconductive element and exposing the surface bearing the electrostatic image to a developer which contains a toner charged to a polarity opposite to that of the image thereby inducing deposition of the toner on the image. The visible toner image consequently obtained, when necessary, may be transferred to a transfer paper and fixed thereon to obtain a copy.

The charging of the toner which is used for developing such electrostatic image is fulfilled in the two-component developing method by mixing and diffusing the toner with a substance generally called a carrier thereby imparting an electric charge to the toner, or in the one-component developing method by causing the toner to contact a developing sleeve or a toner regulating plate thereby imparting an electric charge to the toner. In any event, the steps of development and transfer of the image pose various problems unless the electric charge is imparted uniformly and stably to the toner. For example, the inferiority of developed image due to the lack of the developer soavenging effect and the developing electrode effect and the liability of the sensitizing surface to gather smear due to insufficient transfer of developed image are counted among the problems.

For the purpose of solving these problems, JP-A-52-135,739 proposes an electrostatic image developing toner which has as a component thereof a metal oxide or silicone dioxide powder treated with amino silane. Since this toner is capable of maintaining a positive charge property, it is enabled to exhibit its developing property and transferring property at improved levels. When the metal oxide powder or silicon dioxide powder is blended with the binding resin of the toner and the coloring agent such as carbon black, however, it inevitably poses problems such as consuming much time for dispersion and suffering ready agglomeration of the produced toner particles. For the purpose of improving the fluidity of toner and enhancing the stability of charging, the practice of adding hydrophobic colloidal silica to toner particles has been introduced to the art and put to use (as disclosed in JP-B-63-36,499, for example). The addition of such colloidal silica indeed results in improving the fluidity of toner. It nevertheless consumes much time for dispersion of components being mixed during the manufacture of toner as in the former case and fails to enhance the charging property of toner to a fully satisfactory extent. Specifically, it entails the problem that unduly heavy fogging and unduly low image density ensue when the total number of produced copies exceeds 10,000 to 20,000. This particular problem gains in consipicuity with rising temperature and moisture of the ambience.

JP-A-63-101,854 discloses a toner containing a polymethylsilsesquioxane powder possessing a negative charge property and JP-A-63-101,855 a toner containing a polymethylsilsesquioxane powder endowed with a positive charge property by a surface treatment with an amino group-containing silane compound. Though these toners enjoy fully satisfactory charge properties, they have the problem that they suffer loss of fluidity, tend to smear the sensitizing surface, and exhibit a poor transferring property because the polymethylsilsesquioxane has unduly low mechanical strength.

SUMMARY OF THE INVENTION

It is, therefore, an object of this invention to provide a novel electrostatic image developer. Another object of this invention is to provide an electrostatic image developer which is improved in various properties such as fluidity, charging property, and transferring property.

To accomplish the objects described above, this invention provides an electrostatic image developer, which comprises:

toner particles containing (a) a binding resin and (b) a coloring agent and having a mean particle diameter of not more than 25 $\mu$m; and (c) organic-inorganic composite particles attached or fixed to the surface or to the proximity of surface of the toner particles, containing an organic polymer framework and a polysiloxane framework, wherein the polysiloxane framework has in the molecule thereof an organosilicon which has a silicon atom to which at least one carbon atom in the organic polymer framework combined directly, the (c) organic-inorganic composite particles having $SiO_2$ as a component of polysiloxane framework at a content in the range of 10 to 90% by weight, and the composite particles having a mean particle diameter in the range of 0.01 to 5 $\mu$m;

the mixing ratio of (b) the coloring agent to (a) the binding resin in the toner particles being 20 to 2 parts by weight of (b) the coloring agent to 80 to 98 parts by weight of (a) the binding resin, when the total amount of (a) and (b) is 100 parts; and the mixing ratio of the organic-inorganic composite particles to the toner particles being 0.01 to 20 parts by weight of the organic-inorganic composite particles to 100 parts by weight of the toner particles.

In the electrostatic image developer of this invention, it is preferable that the (c) the organic-inorganic composite particles have the $SiO_2$ which constitutes the polysiloxane framework at a content in the range of 25 to 85% by weight.

In the electrostatic image developer of this invention, (c) the organic-inorganic composite particles appropriately have a mean particle diameter in the range of 0.01 to 2 $\mu$m.

In the electrostatic image developer of this invention, it is preferable that the mixing ratio of (c) the organic-inorganic composite particles to 100 parts by weight of the toner particles appropriately is in the range of 0.1 to 3 parts by weight.

This invention further provides an electrostatic image developer, wherein (c) the organic-inorganic composite particles are obtained by a step of hydrolyzing and condensing at least one radically polymerizable group-containing, hydrolyzable and condensable silicon compound selected from the group consisting of compounds represented by the following general formula (I):

$$R_m^1SiX_{4-m} \quad (I)$$

(wherein $R^1$ stands for a radically polymerizable organic group having $C_2$~$C_{20}$, X for a $C_1$~$C_5$ alkoxy group or an acyloxy group, and m for an integer in the range of 1 to 3, providing that where m is 2 or more, at least one of the plurality of substituents $R^1$'s may be a radically polymerizable organic group having $C_2$~$C_{20}$ and the remainder may be an organic group containing no radically polymerizing group) and derivatives thereof, and a step of subjecting the radically polymerizable groups to a reaction of radical polymerization.

In this invention, it is preferable that the substituent $R^1$ in the general formula (I) mentioned above is at least one group selected from the class consisting of:

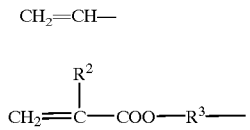

(wherein $R^2$ stands for a hydrogen atom or a methyl group and $R^3$ for a $C_1$~$C_{10}$ alkylene group)

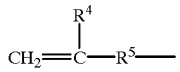

(wherein $R^4$ stands for a hydrogen atom or a methyl group and $R^5$ for a phenylene group or a $C_1$~$C_{10}$ alkylene group).

This invention further provides an electrostatic image developer, wherein (c) the organic-inorganic composite particles are obtained by a step of partially or wholly hydrolyzing in the presence of an acid at least one hydrolyzable and condensable silicon compound selected from the group consisting of compounds represented by the following general formula (I):

$$R_m^1SiX_{4-m} \quad (I)$$

(wherein $R^1$ stands for a radically polymerizable organic group having $C_2$~$C_{20}$, X for a $C_1$~$C_5$ alkoxy group or an acyloxy group, and m for an integer in the range of 1 to 3, providing that where m is 2 or more, at least one of the plurality of substituents $R^1$'s may be a radically polymerizable organic group having $C_2$~$C_{20}$ and the remainder may be an organic group containing no radically polymerizable group) and derivatives thereof, thereby forming a hydrolyzate and/or a condensate thereof, a step of polycondensing the hydrolyzate and/or the condensate thereof in the presence of a base, and a step of subjecting the radically polymerizable group to a reaction of radical polymerization.

This invention further provides an electrostatic image developer, wherein the substituent $R^1$ in the general formula (I) mentioned above is at least one group selected from the class consisting of:

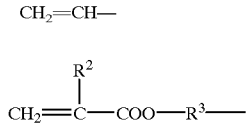

(wherein $R^2$ stands for a hydrogen atom or a methyl group and $R^3$ for a $C_1$~$C_{10}$ alkylene group)

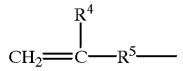

(wherein $R^4$ stands for a hydrogen atom or a methyl group and $R^5$ for a phenylene group or a $C_1$~$C_{10}$ alkylene group).

This invention further provides an electrostatic image developer, wherein (c) the organic-inorganic composite particles are obtained by a method comprising a step of partially or wholly hydrolyzing at least one hydrolyzable and condensable silicon compound selected from the group consisting of compounds represented by the following general formula (Ib):

$$R_n^6SiX_{4-n} \quad (Ib)$$

(wherein $R^6$ stands for a $C_1$~$C_{20}$ organic group, X for a $C_1$~$C_5$ alkoxy group or an acyloxy group, and n for 0 or 1, providing that the plurality of substituents X's may be identical with or different from on another) and derivatives thereof in the presence of an acid, thereby forming a hydrolyzate and/or a condensate thereof, and a step of polycondensing the hydrolyzate and/or the condensate thereof in the presence of a base, and performing either or both of the hydrolyzing step and the polycondensing step in the presence of a polymer containing a group represented by the following general formula (II):

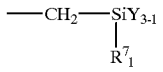

(II)

(wherein $R^7$ stands for a $C_1$~$C_{20}$ organic group, Y for a hydrolyzable group, and l for 0 or 1).

This invention further provides an electrostatic image developer, wherein the polymer mentioned above is obtained by homopolymerizing at least one radically polymerizable group containing, hydrolyzable and polymerizable silicon compound selected from the group consisting of compounds represented by the following general formula (III) and derivatives thereof, or copolymerizing the compound with a copolymerizable organic monomer.

$$R^8_pSiY_{4-p} \quad (III)$$

(wherein $R^8$ stands for a group selected from the class consisting of

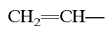

(a)

(b)

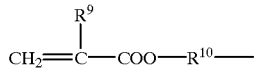

(wherein $R^9$ stands for a hydrogen atom or a methyl group and $R^{10}$ for a $C_1$~$C_{10}$ alkylene group)

(c)

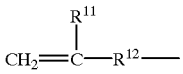

(wherein $R^{11}$ stands for a hydrogen atom or a methyl group and $R^{12}$ for a phenylene group or a $C_1$~$C_{10}$ alkylene group); Y for a hydrolyzable group; and p for an integer in the range of 1 to 3; providing that where p is 2 or more, one of the plurality of substituents $R^8$'s is a radically polymerizable organic group of $C_2$~$C_{20}$ and the remainder is a $C_1$~$C_{20}$ organic group containing no radically polymerizable group.).

This invention, therefore, is capable of providing an electrostatic image developer which has a prescribed amount of charge and exhibiting a stable charge retaining ratio for a long time.

DETAILED DESCRIPTION OF THE INVENTION

Figure 1:
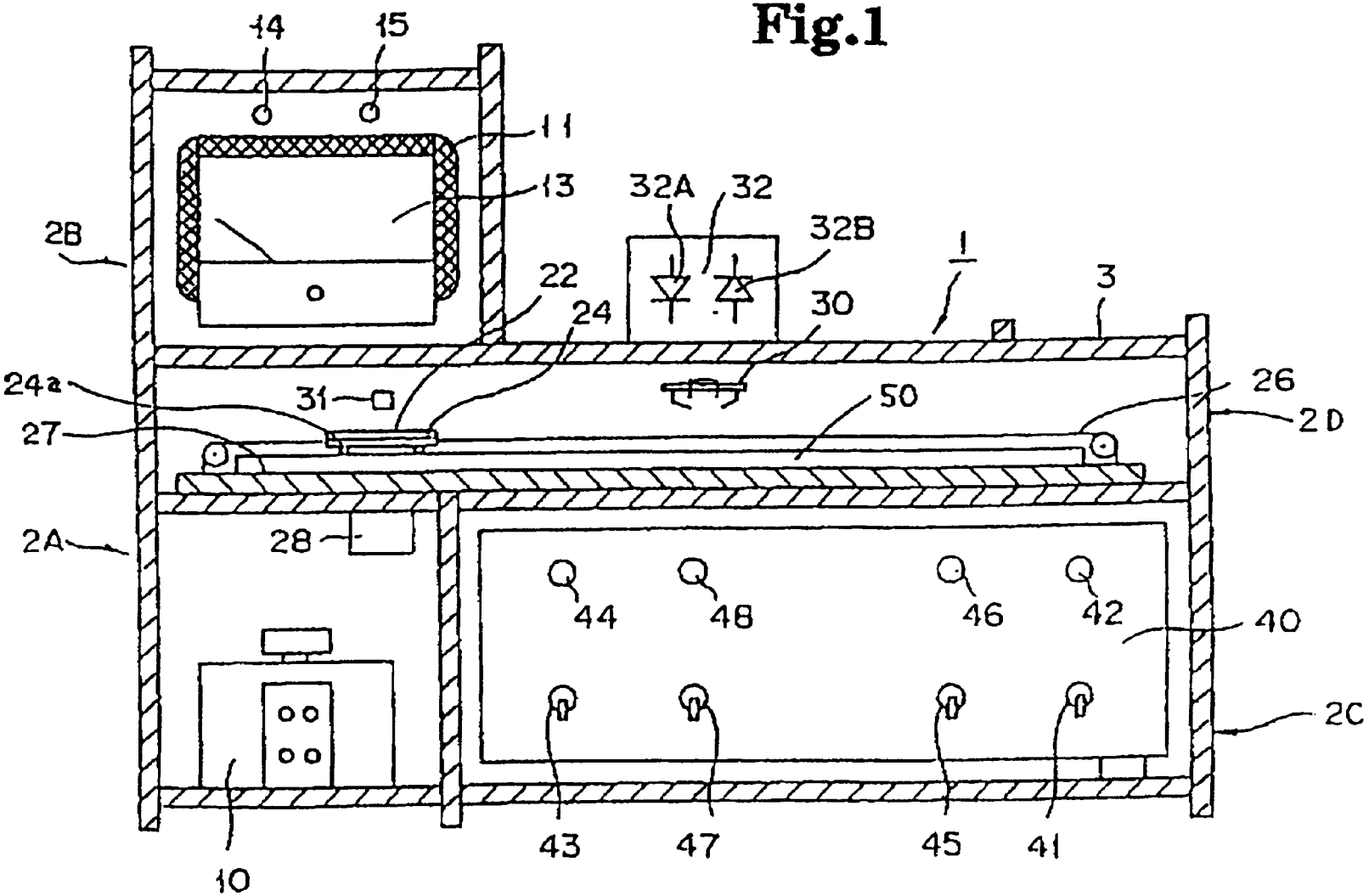
FIG. 1 is a sectional view schematically illustrating the construction of a corona charging property measuring device used for determining the charge retaining ratio in the working examples of this invention.

Now, this invention will be explained more specifically hereinbelow.

Organic-Inorganic composite particles

The organic-inorganic composite particles which are contained in the electrostatic image developer of this invention comprise an organic polymer framework and a polysiloxane framework, wherein the polysiloxane framework contains in the molecule thereof an organosilicon which has a silicon atom to which at least one carbon atom in the organic polymer framework is combined directly.

The polysiloxane framework fulfills the role of enhancing the hardness of the particles and the organic polymer framework the role of enhancing the mechanical strength (fracture strength) of the particle. When the particles mentioned above are used as an additive to the toner, they precludes the sensitized surface from gathering smear and the obtained toner enables such properties thereof as fluidity and transferability to be improved because they both the polysiloxane framework and the organic polymer framework. In contrast, the toner which uses particles containing a polysiloxane framework alone such as polymethylsilsesquioxane particles tends to defile the sensitized surface and rather degrades such properties thereof as fluidity and transferability because the particles are deficient in mechanical strength. Then, the toner which uses particles containing an organic polymer framework alone such as polymethyl methacrylate type particles tends to defile the sensitized surface and degrades and fluidity and transferability thereof because the particles are deficient in hardness. Further, since these particles have an unduly low charge retaining ratio, the produced toners manifest unstable charging properties.

The term "organic polymer framework" mentioned above refers to a framework which contains at least a main chain selected from the group consisting of main chain, side chain, branched chain, and cross-lined chain which originate in an organic polymer and it is not defined by the molecular weight, composition, and structure of the organic polymer or the presence or absence of a functional group therein. The organic polymer can be, but not limited to, at least one member selected from the group consisting of (meth)acrylic resins, polystyrene, polyvinyl chloride, polyvinyl acetate, polyolefins, and polyesters. Preferably, the organic polymer framework is possessed of a main chain which is formed of repeating units —C—C— (hereinafter referred to occasionally as "vinyl type polymer").

The term "polysiloxane framework" as used in this invention refers to a three-dimensional network which is formed by continuous chemical bondage of siloxane units represented by the following formula:

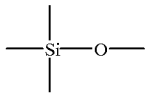

The term "organosilicon" as used in this invention refers to the product of direct chemical bondage of at least one carbon atom in the organic polymer framework to at least one silicon atom contained in the siloxane units mentioned above. Thus, this chemical bondage allows union of one to three organic polymers per a silicon atom.

In the organic-inorganic composite particles according to this invention, the amount of $SiO_2$ which forms a component of the polysiloxane framework appropriately accounts for a content in the range of 10 to 90% by weight, preferably 25 to 85% by weight, and more preferably 30 to 75% by weight. If the amount of the $SiO_2$ as a component of the polysiloxane framework is less than 10% by weight, the possibility ensues that the organic-inorganic composite particles will be deficient in charging property and mechanical strength and the electrostatic image developer incorporating the composite particles will fail to acquire necessary cleaning property. Conversely, if the amount of $SiO_2$ is extremely large so as to exceed 90% by weight, for example, the possibility arises that the organic-inorganic composite particles will fail to deform under an external pressure and tend to break and exhibit no stable charging property and an unduly low charge retaining ratio.

The organic-inorganic composite particles of this invention appropriately assume a spherical shape in respect that this shape goes to improve the toner in fluidity and transferring property.

The mean particle diameter of the organic-inorganic composite particles is not particularly critical so long as it falls in the approximate range of 0.01 to 5 $\mu$m, preferably in the range of 0.05 to 2 $\mu$m, more preferably in the range of 0.05 to 1 $\mu$m, and most preferably in the range of 0.05 to 0.5 $\mu$m. If the mean particle diameter is markedly smaller than 0.01 $\mu$m, the possibility arises that even when the amount of these particles added to the electrostatic image developing toner is increased, the toner will fail to acquire a fully satisfyingness with respect to the fluidity and transferring property. Conversely, if the mean particle diameter is markedly larger than 5 $\mu$m, the possibility arises that the composite particles will not be easily distributed uniformly within toner particles and, as a result, the toner particles will acquire an uneven charge and suffer loss of fluidity.

The charge retaining ratio of the organic-inorganic composite particles appropriately is as high as possible in the sense that the charging properties of the toner improve in proportion as the charge retaining ratio increases. To be concrete, the charge retaining ratio as determined 5 minutes after the charging by the method which will be described specifically herein below is not less than 30%, preferably not less than 40%, and more preferably not less than 50%.

Method 1 for production of organic-inorganic composite particles

The organic-inorganic composite particles described above can be obtained, for example, by a step of hydrolyzing and condensing at least one silicon compound which is hydrolyzable and condensable and has radically polymerizable group(s), which silicon compound being selected from the group consisting of compounds represented by the following general formula (I):

$$R_m^1SiX_{4-m} \quad (I)$$

(wherein $R^1$ stands for a radically polymerizable organic group of $C_2$~$C_{20}$, X for a hydrolyzable group, and m for an integer in the range of 1 to 3, providing that where m is 2 or more, at least one of the plurality of substituents $R^1$'s may be a radically polymerizable group-containing $C_2$~$C_{20}$ organic group and the remainder may be an organic group containing no radically polymerizable group) and derivatives thereof, and a step of subjecting the radically polymerizable groups to a reaction of radical polymerization.

As the hydrolyzable group X in the compounds represented by the aforementioned general formula (I), a monovalent group selected from among halogen atoms, alkoxy groups, and acyloxy groups may be cited, for example, but not limited thereto. These hydrolyzable groups are fit for use in this invention because they are hydrolyzed with water and, when condensed, are allowed to form polysiloxanes. Among other hydrolyzable groups mentioned above, $C_1$~$C_5$ alkoxy groups such as methoxy group, ethoxy group, and propoxy group, or acyloxy groups prove advantageous. Particularly, methoxy group, ethoxy group, and propoxy group are desirable. When X is a $C_1$~$C_5$ alkoxy group or an acyloxy group, this hydrolyzable group enables the compound which occurs as a by-product when the compound represented by the general formula (I) is hydrolyzed and condensed to be easily removed from the reaction system and does not allow the by-product to survive as an impurity.

The symbol $R^1$ in the general formula (I) mentioned above stands for a radically polymerizable organic group of $C_2$~$C_{20}$. The radically polymerizable organic group of $C_2$~$C_{20}$ include, but not limited to, acryloxyalkyl groups, methacryloxyalkyl groups, vinyl group, isopropenyl group, 1-alkenyl group, or isoalkenyl groups, for example. Preferably, $R^1$ is at least one of the groups represented by the following general formulas:

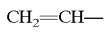

$CH_2{=}CH{-}$

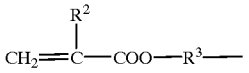

$CH_2{=}C(R^2){-}COO{-}R^3{-}$ (wherein $R^2$ stands for a hydrogen atom or a methyl group and $R^3$ for a $C_1$~$C_{10}$ alkylene group)

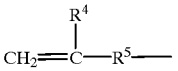

$CH_2{=}C(R^4){-}R^5{-}$ (wherein $R^4$ stands for a hydrogen atom or a methyl group and $R^5$ for a phenylene group or a $C_1$~$C_{10}$ alkylene group).

When m in the general formula (I) is 2, the two $R^1$'s may be different from each other or identical with each other. When m is 3, the three $R^1$'s may be different from one another or two or more $R^1$'s may be identical with each other. When 4-m is 2, the two X's may be different from each other or identical with each other. When 4-m is 3, the three X's may be different from one another or two or more X's may be identical with each other.

It should be noted that among the compounds represented by the general formula (I) mentioned above, which can be independently usable are exclusively those compounds which are selected from the group consisting of compounds of the formula (I) satisfying m=1 and derivatives thereof. In independent use, only these compounds are capable of obtaining the organic-inorganic composite particles contemplated by this invention.

As concrete examples of the compound represented by the general formula (I) and used for this invention, the following compounds may be cited as unrestricted examples.

The compounds of the general formula (I) satisfying m=1 are such organotrialkoxy silane compounds and organotriacetoxy silane compounds as γ-methacryloxypropyl trimethoxy silane, γ-methacryloxypropyl triethoxy silane, γ-acryloxypropyl trimethoxy silane, γ-acryloxypropyl triethoxy silane, γ-methacryloxypropyl triacetoxy silane, vinyl trimethoxy silane, vinyl triethoxy silane, vinyl triacetoxy silane, 1-hexenyl trimethoxy silane, 1-octenyl trimethoxy silane, and p-vinylphenyl trimethoxy silane.

The compounds of the general formula (I) satisfying m=2 are such diorganodialkoxy silane compounds as bis(γ-acryloxypropyl)dimethoxy silane, bis(γ-methacryloxypropyl)-dimethoxy silane, γ-methacryloxypropyl ethyldimethoxy silane, γ-methacryloxypropyl ethyldiethoxy silane, γ-acryloxypropyl ethyldimethoxy silane, and γ-acryloxypropyl ethyldiethoxy silane.

The compounds of the general formula (I) satisfying m=3 are such triorganoalkoxy silane compounds as tris(γ-acryloxypropyl) methoxy silane, tris(γ-acryloxypropyl) ethoxy silane, tris(γ-methacryloxypropyl) methoxy silane, tris(γ-methacryloxypropyl) ethoxy silane, bis(γ-acryloxypropyl) vinyl methoxy silane, bis(γ-methacryloxypropyl) vinyl methoxy silane, γ-acryloxypropyl diethylmethoxy silane, γ-acryloxypropyl diethyl ethoxy silane, γ-methaoryloxypropyl diethylmethoxy silane, and γ-methacryloxypropyl diethylethoxy silane.

Among other compounds of the general formula (I) mentioned above, γ-methacryloxypropyl trimethoxy silane, γ-methacryloxypropyl triethoxy silane, γ-acryloxypropyl trimethoxy silane, γ-acryloxypropyl triethoxy silane, γ-methacryloxypropyl triacetoxy silane, vinyl trimethoxy silane, vinyl triethoxy silane, vinyl triacetoxy silane, and p-vinylphenyl trimethoxy silane prove particularly appropriate.

The production of the organic-inorganic composite particles according to this invention by the use of a compound represented by the general formula (I) is accomplished by a step by hydrolyzing and condensing the compound of the general formula (I) (hereinafter referred to occasionally simple as "raw material") in a solvent containing water, and a step of subjecting the radically polymerizable group to a reaction of radical polymerization. To be specific, when the compound of the general formula (I) is hydrolyzed and condensed, and the resultant particulate intermediate is radically polymerized, an organic polymer framework, particularly a three-dimensional organic polymer framework, is formed by the radical polymerization of the radically polymerizable groups.

The hydrolysis and the condensation can be effected by any of the known methods such as, for example, a bulk method, an intermittent method, and a continuous method.

For the sake of the hydrolysis and the condensation, basic catalysts such as ammonia, urea, ethanol amine, tetramethyl ammonium hydroxide, alkali metal hydroxides, and alkaline earth metal hydroxides and acid catalysts such as organic acids including formic acid, acetic acid, propionic acid, monochloro acetic acid, oxalic acid, citric acid, dodecylbenzene sulfonic acid, lauryl sulfuric acid, lauric acid, stearic acid, and p-toluenesulfonic acid and inorganic acids including hydrochloric acid, nitric acid, sulfuric acid, and carbonic acid can be used. However, the catalysts usable in this method are not limited to the above non-exhaustive examples.

The solvent permits presence therein of an organic solvent besides water and a catalyst. As concrete, but non-exhaustive, examples of the organic solvent, alcohols such as methanol, ethanol, isopropanol, n-butanol, isobutanol, sec-butanol, t-butanol, pentanol, ethylene glycol, propylene glycol, and 1,4-butane diol; ketones such as acetone and methylethyl ketone; esters such as ethyl acetate, (cyclo) paraffins such as isooctane and cyclohexane; ethers such as dioxane and diethyl ether; and aromatic hydrocarbons such as benzene and toluene may be cited. These solvents may be used either singly or in the form of a mixture of two or more members.

The hydrolysis and the condensation are carried out, for example, by adding a compound represented by the general formula (I) or the solution of this compound in an organic solvent to a medium containing water and stirring the resultant mixture at a temperature in the range of 0 to 100° C., preferably in the range of 0 to 70° C., for a period in the range of 30 minutes to 100 hours.

Optionally, the particles which are obtained by the method described above may be preparatorily placed as seed particles in a system for synthesis, the raw material mentioned above may be added to the system, and the seed particles may be grown therein.

When the raw material is hydrolyzed and condensed in the medium containing water under suitable conditions, particles are precipitated and a slurry is formed. Since the particles thus precipitated have resulted from hydrolyzing and condensing a compound represented by the general formula (I), they acquire a necessary mean particle diameter in the range of 0.01 to 5 $\mu$m and have a narrow particle size distribution. As the "suitable conditions" mentioned above, the concentration of the compound of the general formula (I) which is not more than 20% by weight, the concentration of the water which is not less than 50% by weight, and the concentration of the catalyst which is not more than 10% by weight, respectively relative to the produced slurry are advantageously used.

The particles which are produced by the hydrolysis and the condensation have such a mean particle diameter that the organic-inorganic composite particles according to this invention are allowed to acquire a mean particle diameter in the range mentioned above by setting the water concentration, catalyst concentration, organic solvent concentration, raw material concentration, time of addition of the raw material, temperature, and concentration of the seed particles in the respective ranges of 50 to 99.99% by weight, 0.01 to 10% by weight, 0 to 90% by weight, 0.1 to 30% by weight, 0.001 to 500 hours, 0 to 100° C., and 0 to 10% by weight.

In the hydrolysis and the polycondensation of a radically polymerizing group-containing, hydrolyzable and condensable silicon compound, other hydrolyzable and condensable metal compound and silica sol may be additionally used.

As concrete, but non-exhaustive, examples of the hydrolyzable and condensable metal compound, organosilicic compounds including tetraalkoxy silanes such as tetramethoxy silane, tetraethoxy silane, tetrapropoxy silane, and tetrabutoxy silane, trialkoxy silanes such as methyl trimethoxy silane, methyl triethoxy silane, and ethyl trimethoxy silane, and the low condensates of such tetraalkoxy silanes and trialkoxy silanes, and the organometal compounds derived from the organosilicic compounds by the substitution of metal elements such as Ti, Zr, and Al for the Si of the organosilicic compounds may be cited. At least one compound selected from among the compounds cited above is used. As a typical example of the silica sol, a slurry resulting from dispersing minute silica particles of a mean particle diameter of not more than 30 nm in water and/or in organic solvent such as an alcohol may be cited, but not limited thereto.

The radical polymerization may be effected by preparing the particles resulting from the hydrolysis and the condensation in the form of a slurry in a water-containing solvent, dissolving a water-soluble or oil-soluble radical polymerization initiator in the slurry, and subjecting the resultant solution as such to polymerization, alternatively, by isolating from the slurry the particles produced by the hydrolysis and the condensation by any of such known methods as filtration, centrifugation, and reduced-pressure concentration, dispersing the isolated particles in the solution of a radical polymerization initiator in water or an organic solvent, and subjecting the resultant dispersion to polymerization. Of course, these are no exclusive methods which are available for the radical polymerization under discussion.

It is also allowable to subject the radically polymerizable group to the reaction of radical polymerization prior to the step of condensation.

In all these methods, the method which comprises continuing the hydrolysis and the condensation of the raw material and meanwhile initiating the radical polymerization by addition of a radical polymerization initiator to the reaction system proves particularly advantageous. This is because the formation of such polysiloxane as mentioned above and the formation of an organic polymer by polymerization proceed in parallel and, as a result, the organic-inorganic composite particles of this invention is easily obtained as distinctly improved in such properties as charging property, fluidity, and resistance to agglomeration.

The radical polymerization initiator to be used in the radical polymerization may be any of the known substances which are capable of initiating radical polymerization. Although it is not particularly defined, at least one compound selected from among azo compounds and peroxides is suitably used.

The amount of the radical polymerization initiator is not particularly critical. If this amount is unduly large, however, the amount of heat evolved during the radical polymerization will be so large as to render the control of the reaction difficult. Conversely, if the amount is unduly small, the radical polymerization will possibly fail to proceed. Appropriately, this amount is in the range of 0.1 to 5% by weight, preferably 0.3 to 2% by weight, based on the total weight of the compound represented by the general formula (I) mentioned above.

Although the temperature for the radical polymerization can be suitably selected by the kind of radical polymerization initiator to be used, it is properly set in the range of 30 to 100° C., preferably in the range of 50 to 80° C., with a view to facilitating the control of the reaction.

The radical polymerization permits the presence in the reaction system of a monomer which has a group radically polymerizable with the radically polymerizable group of the compound represented by the general formula (I) mentioned above. As concrete, but non-exhaustive, examples of this monomer, unsaturated carboxylic acids such as acrylic acid and methacrylic acid; unsaturated carboxylic esters such as acrylic esters, methacrylic esters, crotonic esters, itaconic esters, maleic esters, and fumaric esters; aromatic vinyl compounds such as acryl amides, methacryl amides, styrene, α-styrene, and divinyl benzene; vinyl esters such as vinyl acetate; halogenated vinyl compounds such as vinyl chloride; and other similar vinyl compounds may be cited. At least one of these monomers may be used. Among other monomers cited above, such monomers as divinyl benzene, trimethylol propane trimethacrylate, and ethylene glycol dimethacrylate which contain two or more radically polymerizable groups prove particularly suitable.

If the amount of such a monomer to be used is unduly large, however, the amount of $SiO_2$ as a component of the polysiloxane framework in the produced organic-inorganic composite particles will possibly fall short of 10% by weight and the produced organic-inorganic composite particles will fail to manifest necessary properties. Appropriately, therefore, the amount of the monomer is in the range of 0 to 50% by weight, preferably 0 to 30% by weight, based on the weight of the compound of the general formula (I) mentioned above.

It is advantageous to perform such a step of recondensation as will be specifically described herein below subsequently to the hydrolysis, the condensation, and the radical polymerization in respect that this step further improves the ultimately produced organic-inorganic composite particles in such properties as hardness. The recondensation is a step for further advancing the condensation in the organic solvent of the polymer particles which have been formed by the radical polymerization. For the sake of advancing the condensation, the catalyst mentioned above may be used. As concrete examples of the catalyst which is beneficial for further promoting the condensation, organotitanium compounds such as titanium tetraisopropoxide, titanium tetrabutoxide, and diisopropoxy-bis(acetylacetoneate) titanate; organoaluminum compounds such as aluminum triisopropoxide, aluminum tri-sec-butoxide, aluminum tris-acetyl acetonate, and aluminum isopropoxide-bis-acetyl acetonate; organnozirconium compounds such as zirconium tetrabutoxide and tetrakis(acetyl acetonate) zirconium; organotin compounds such as dibutyl tin diacetate, dibutyl tin diethyl hexanoate, and dibutyl tin dimaleate; and acid phosphoric esters such as $(CH_3O)_2P(=O)OH$, $(CH_3O)P(=O)(OH)_2$, $(CH_4H_9O)_2P(=O)OH$, and $(C_8H_{17}O)P(=O)(OH)_2$ may be cited. These catalysts may be used either singly or in the form of a mixture of two or more members. Among other catalysts cited above, at least one catalyst selected from the group consisting of organotin compounds and acid phosphoric esters proves particularly advantageous.

At the step of recondensation mentioned above, the particles appropriately contain no water. This is because the dehydration condensation of the silanol group proceeds more easily in the absence of water. At the step of recondensation, therefore, the slurry obtained at the step of polymerization can be directly used therein when it contains no water. When this slurry happens to contain water, it is appropriate to isolate the polymer particles from this slurry by any of the known methods such as, for example, filtration, centrifugation, and reduced-pressure concentration, then disperse the isolated polymer particles in an organic solvent, and subject them to the recondensation. The organic solvent to be used for the dispersion may be at least one member selected from the group consisting of alcohols, ketones, esters, paraffins, ethers, and aromatic hydrocarbons mentioned above. The recondensation is implemented by stirring the slurry of the polymer particles in the organic solvent at a temperature in the range of 50 to 200° C., preferably in the range of 60 to 150° C., for a period in the range of 30 minutes to 100 hours. The pressure under which the recondensation is carried out may be normal pressure, reduced pressure, or increased pressure, whichever befits the reaction.

When the organic-inorganic composite particles which have been produced by the hydrolysis, condensation, and polymerization (plus recondensation, optionally) as described above are isolated from the slurry by any of the well-known methods such as filtration, centrifugation, reduced-pressure concentration, spray drying, and instantaneous vacuum drying, and then subjected to a heat treatment for drying and firing at a temperature not exceeding 800° C., preferably falling in the range of 100 to 600° C., more preferably in the range of 150 to 500° C., and most preferably in the range of 200 to 450° C., such organic-inorganic composite particles as are possessed of suitable charging property and necessary mechanical properties including suitable hardness as contemplated by this invention are obtained.

The organic-inorganic composite particles which are obtained by hydrolyzing, condensing, and further polymerizing a compound represented by the general formula (I) are possessed of a negative property. These organic-inorganic composite particles can be used in their unmodified form as an additive to a toner for the purpose of permitting control of charge, impartation of fluidity, and etc. In order to dispose of the hydroxyl group persisting on the surface of these particles and adjust the amount of negative charge, they may be given a surface treatment with a silicic compound such as organotrialkoxy silane or hexamethyl disilane, a titanium compound such as tetrabutyl titanate, or the product of hydrolysis and condensation of such compound.

For the purpose of conferring a positive charge property instead on the organic-inorganic composite particles of this invention, the idea of subjecting the compound represented by the general formula (I) mentioned above to the hydrolysis by the general formula (I) mentioned above to the hydrolysis and the condensation in tandem with an amino group-containing silane compound represented by the following general formula (IV):

$$R^{13}_{q}SiZ_{4-q} \quad \text{(IV)}$$

(wherein $R^{13}$ stands for an amino group-containing organic group (providing that when q is 2 or more, at least one of the plurality of organic groups may be an amino group-containing organic group and the remainder may be an organic group containing no amino group), Z for a hydrolyzable group, and q for an integer in the range of 0 to 3).

For the purpose of hydrolyzing and condensing the compound represented by the general formula (I) in combination with such an amino group-containing silane compound as is represented by the general formula (IV), it suffices to mix the compound of the general formula (I) and the amino group-containing silane compound represented by the general formula (IV) at a suitable ratio such that the amount of the latter compound falls in the range of 0.1 to 100 mol %, preferably 0.5 to 50 mol %, and most preferably 1 to 20 mol %, based on the amount of the former compound and hydrolyze, condense (and polymerize) the resultant mixture by the method under the conditions substantially similar to those mentioned above.

As concrete examples of the amino group-containing silane compound represented by the general formula (IV), 3-(2-aminoethyl aminopropyl) dimethoxymehtyl silane, 3-ureidopropyl triethoxy silane, 3-aminopropyl triethoxy silane, 3-dimethylaminopropyl triethoxy silane, 3-(2-aminoethyl aminopropyl) trimethoxy silane, 3-aminopropyl trimethoxy silane, 3-dimethyl aminopropyl trimethoxy silane, 3-diethyl aminopropyl trimethoxy silane, 3-[2-(2-aminoethyl aminoethylamino) propyl] trimethoxy silane, aminophenyl trimethoxy silane, N-phenyl-3-aminopropyl trimethoxy silane, and N-phenyl-3-aminopropyl triethoxy silane may be cited, but not limited thereto.

The impartation of a positive charge property to the organic-inorganic composite particles of this invention is otherwise attained by a method which comprises causing the compound represented by the general formula (I) to polymerize in the presence of a radically polymerizable amino group-containing monomer such as acrylamide, methacrylamide, a N-dialkylaminoalkyl acrylate, or a N-dialkylaminoalkyl methacrylate thereby effecting copolymerization of the two compounds.

Alternatively, the impartation of the positive charge property to the organic-inorganic composite particles obtained by the hydrolysis, condensation (and polymerization) as described above can be attained by after treating these organic-inorganic composite particles with a surface-treating agent. As concrete examples of the surface-treating agent, amino group-containing silane compounds as mentioned above; aluminum compounds such as aluminum ethylate, aluminum isopropylate, mono-sec-butoxyaluminum diisopropylate, aluminum-sec-butylate, and ethylacetoacetate aluminum diisopropylate and/or the partial hydrolyzate-condensates thereof may be cited, but not limited thereto.

The after treatment with the surface-treating agent may be implemented by any method so long as the method is capable of causing the surface of the organic-inorganic composite particles obtained by the hydrolysis, condensation, and polymerization as described above to be coated with the surface-treating agent mentioned above. It may be fulfilled, for example, by placing the organic-inorganic composite particles in a suitable container, then adding the surface-treating agent to the container, and thereafter stirring the contents of the container for the sake of intimate contact at a temperature in the approximate range of from normal room temperature (25° C.±5° C.) to 200° C. for a period in the range of 10 minutes to five hours. The composite particles can be treated with exalted uniformity in this case by preparing a solution of the surface-treating agent in an alcohol such as methanol and then gradually adding dropwise the resultant solution to the container during the course of the mixing for contact. The amount of the surface-treating agent to be deposited by adsorption on the surface of the organic-inorganic composite particles can be adjusted by suitably selecting the kind of surface-treating agent, duration of the treatment, the particle diameter of the organic-inorganic composite particles, etc., depending on the magnitude of charge to be imparted. By way of after treatment, the organic-inorganic composite particles resulting from the surface treatment are purged of an extraneous substance still remaining on their surface by a cleaning treatment with an alcohol, for example.

Method 2 for production of organic-inorganic composite particles

The organic-inorganic composite particles of this invention described above are further obtained advantageously by a method comprising a step of partially or wholly hydrolyzing at least one hydrolyzable and condensable silicon compound represented by the general formula (I) mentioned in the preceding section titled "Method 1 for production of organic-inorganic composite particles" and derivatives thereof in the presence of an acid, thereby forming a hydrolyzate and/or a condensate thereof, a step of polycondensing the hydrolyzate and/or the condensate thereof in the presence of a base, and a step of subjecting the radically polymerizable group to a reaction of radical polymerization. To be specific, when the compound of the general formula (I) is hydrolyzed in the presence of an acid, polycondensed in the presence of a base, and the particulate intermediate consequently produced is radically polymerized, the radically polymerizable group undergoes radical polymerization and, as a result, an organic polymer framework is formed and, at the same time, a polysiloxane framework is formed during the step of polycondensation.

By this method, minute particles can be efficiently obtained even at a high concentration without inducing agglomeration.

At the first step of hydrolysis of this method, the acid destined to serve as a catalyst is dissolved in an excess amount of water so as to be used in the form of an aqueous solution. In this invention, since the hydrolysis is carried out in the presence of the acid, the minute particles are easily obtained without being agglomerated at the step of polycondensation even at a high concentration.

As concrete examples of the acid catalyst which can be used at the step of hydrolysis, organic acids such as formic acid, acetic acid, propionic acid, monochloro acetic acid, oxalic acid, citric acid, dodecylbenzene sulfonic acid, lauryl sulfuric acid, lauric acid, stearic acid, and p-toluene sulfonic acid and inorganic acids such as hydrochloric acid, nitric acid, sulfuric acid, and carbonic acid may be cited, but not limited thereto. Among the acid catalysts mentioned above, such acids as dodecylbenzenesulfonic acid, laurylsulfuric acid, lauric acid, and stearic acid prove particularly appropriate in the sense that such acid, when neutralized, manifests surface activity. Such strong acids as dodecylbenzenesulfonic acid and laurylsulfuric acid are distinct from all the acid catalysts enumerated above in that such acid serves the purpose of accelerating the velocity of reaction of the hydrolysis even at a low application rate and curbing the otherwise possible partial condensation of the produced hydrolyzate.

The solvent permits the presence therein of an organic solvent besides water and the acid catalyst. As concrete examples of the organic solvent, those organic solvents which are cited in the preceding section titled "Method 1 for production of organic-inorganic composite particles" may be cited herein.

This step of hydrolysis is implemented, for example, by adding a silicone compound represented by the general formula (I) mentioned above or a solution of the compound in an organic solvent to a medium containing the acid and water and stirring them at a temperature in the range of 0 to 100° C., preferably in the range of 0 to 70° C., for a period in the range of 30 minutes to 100 hours. Properly at the step of this hydrolysis, the concentration of the silicon compound represented by the general formula (I) is in the range of 10 to 80% by weight, that of the water in the range of 10 to 80% by weight, and that of the acid catalyst in the range of 0.001 to 1% by weight.

In the hydrolysis of a radically polymerizable group-containing, hydrolyzable and condensable silicon compound, other hydrolyzable and condensable organometal compound may be additionally used.

As concrete examples of the hydrolyzable and condensable organometal compound, those organometal compounds which are enumerated in the preceding section titled "Method 1 for production of organic-inorganic composite particles" may be cited herein.

The second step of polycondensation is carried out in the aqueous solution of a base or in the mixture of this aqueous solution with and organic solvent. At the second step, the additional use of the organic solvent proves preferably in that this organic solvent serves the purpose of curbing agglomeration of particles and allowing formation of minute composite particles. At the second step, the polycondensation is implemented by placing the aqueous solution of a base or the mixture of this aqueous solution with an organic solvent in a reaction vessel and then adding to this reaction vessel the aqueous solution of the hydrolyzate and/or the condensate thereof obtained at the first step or the solution obtained by further diluting the aqueous solution with water and/or an organic solvent, thereby causing the hydrolyzate and/or the condensate thereof obtained at the first step to contact the base. The method for adding the aqueous solution of the hydrolyzate and/or the condensate thereof obtained at the first step to the aqueous solution of a base and the speed of this addition are not particularly critical. They may be suitably decided in accordance with the kind of silicon compound used, the composition of the aqueous solution of a base, and particularly the presence or absence of the use of the organic solvent.

As concrete examples of the base catalyst to be used at the step of polycondensing the hydrolyzate and/or the condensate thereof obtained at the step of hydrolysis, ammonia, organic amines such as urea, monomethyl amine, dimethyl amine, and ethanol amine; and hydroxides of alkali metals or alkaline earth metals such as tetramethyl ammonium hydroxide, sodium hdyroxide, potassium hydroxide, and lithium hydroxide may be cited, cut not limited thereto. Ammonia and organic amines are distinct from all the base catalysts mentioned above in that they avoid leaving behind any trace of impurities restrictive of use found for the produced particles. Ammonia is particularly advantageous in that it has low toxicity and permits easy removal.

Appropriately at this step of polycondensation, the concentration of the water is in the range of 1 to 99% by weight and that of the base catalyst in the range of 0.01 to 10% by weight and the reaction temperature is in the range of 0 to 50° C.

The third step which resides in subjecting the radically polymerizable group mentioned above to the reaction of radical polymerization may be fulfilled by dissolving a water-soluble or oil-soluble radical polymerization initiator in the aqueous solution of the hydrolyzate and/or the condensate thereof obtained at the first step at the same time that the second step of polycondensation is carried out and polymerizing the resultant solution, by dissolving a water-soluble or oil-soluble radical polymerization initiator in the aqueous solution of the product of hydrolyzate and polycondensate obtained after the completion of the second step and polymerizing the resultant solution, or by isolating the particles obtained by the hydrolysis and the polycondensation by any of the known methods such as filtration, centrifugation, and reduced-pressure concentration, then dispersing the isolated particles in a solution of a radical polymerization initiator in water or an organic solvent, and polymerizing the resultant solution. Of course, these are not exclusive methods.

In these methods, the method which comprises continuing the polycondensation and meanwhile initiating the radical polymerization in the presence of a radical polymerization initiator proves particularly advantageous. This is because the formation of such polysiloxane as mentioned above and the formation of an organic polymer by polymerization proceed in parallel and, as a result, the organic-inorganic composite of this invention is easily obtained as distinctly improved in such properties as charging property, fluidity, and resistance to agglomeration.

The radical polymerization initiator to be used for the radical polymerization is not particularly defined but may be selected from among the known substances available for the purpose of initiating radical polymerization. Appropriately, at least one compound selected from among azo compounds and peroxides is used.

the amount of the radical polymerization initiator to be used is not critical. If this amount is unduly large, the amount of heat evolved during the polymerization will be so large as to render control of the reaction difficult. Conversely, if this amount is unduly small, the radical polymerization will possibly fail to proceed. Appropriately, this amount is in the range of 0.1 to 5% by weight, preferably in the range of 0.3 to 2% by weight, based on the total amount of the compound represented by the general formula (I) mentioned above.

Although the temperature at which the radical polymerization is carried out can be suitably selected by the kind of radical polymerization initiator to be used, properly for the sake of facilitating the control of the reaction, it is in the range of 30 to 100° C., preferably in the range of 50 to 80° C.

The radical polymerization permits the presence in the reaction system of a monomer which is possessed of a group radically polymerizable with the radically polymerizable group of the compound represented by the general formula (I). As concrete examples of this monomer, those monomers which are cited in the preceding section titled "Method 1 for production of organic-inorganic composite particles" may be cited herein. One or more of these monomers may be properly used. Among other monomers mentioned above, such monomers as divinyl benzene, trimethylol propane trimethyacrylate, and ethylene glycol dimethacrylate which contain two or more radically polymrizable groups prove particularly appropriate.

If the amount of such a monomer to be used is unduly large, however, the amount of $SiO_2$ as a component of the polysiloxane framework in the produced organic-inorganic composite particles will possibly fall short of 10% by weight and the produced organic-inorganic composite particles will possibly fail to manifest necessary properties. Appropriately, therefore, the amount of the monomer is in the range of 0 to 50% by weight, preferably 0 to 30% by weight, based on the weight of the compound of the general formula (I) mentioned above.

The organic-inorganic composite particles formed by the hydrolysis, polycondensation, and polymerization as described above, therefore, can be produced at a high concentration without being agglomerated. They are then isolated from the slurry by any of the well-known methods such as filtration, centrifugation, reduced-pressure concentration, spray drying, and instantaneous vacuum drying and then subjected to a heat treatment for drying and firing in air or in an ambience of nitrogen at a temperature not exceeding 800° C., preferably falling in the range of 100 to 600° C., more preferably in the range of 150 to 500° C., and most preferably in the range of 200 to 450° C. As a result, the organic-inorganic composite particles acquire a suitable charging property and necessary mechanical properties such as suitable hardness as contemplated by this invention.

Incidentally, the organic-inorganic composite particles which are obtained by subjecting the compound represented by the general formula (I) to hydrolysis, polycondensation, and further polymerization as described above are possessed of a negative charge property. The methods described in the preceding section titled "Method 1 for production of organic-inorganic composite particles" are similarly applicable herein for disposing of the hydroxyl group persisting on the surface of the organic-inorganic composite particles, for the surface treatment used for adjusting the amount of negative charge, and for the formation of organic-inorganic composite particles possessed of a positive charge property.

Method 3 for production of organic-inorganic composite particles

The organic-inorganic composite particles of this invention described above are further obtained advantageously by a method comprising a step of partially or wholly hydrolyzing at least one hydrolyzable and condensable silicon compound selected from the group consisting of compounds represented by the following general formula (Ib):

$$R^6_nSiX_{4-n} \quad \text{(Ib)}$$

(wherein $R^6$ stands for a $C_1$~$C_{20}$ organic group, X for a hydrolyzable group, and n for an integer in the range of 0 to 3, providing that when n is 2 or more, the plurality of substituents $R^6$'s may be identical with or different from one another and when 4-n is 2 or more, the plurality of X's may be identical with or different from one another.) and derivatives thereof in the presence of an acid, thereby forming a hydrolyzate and/or a condensate thereof, and a step of polycondensing the hydrolyzate and/or the condensate thereof in the presence of a base, and performing either or both of the hydrolyzing step and the polycondensing step in the presence of a polymer containing a group represented by the following general formula (II):

$$-CH_2-\underset{\underset{R^7_l}{|}}{SiY_{3-l}} \quad \text{(II)}$$

(wherein $R^7$ stands for a $C_1$~$C_{20}$ organic group, Y for a hydrolyzable group, and l for 0 to 2.).

As a typical example of the hydrolyzable group X in the compound represented by the general formula (Ib) mentioned above, a monovalent group selected from the class consisting of halogen atoms, alkoxy groups, and acyloxy group may be cited, but not limited thereto. These hydrolyzable groups are fit for use in this invention because they permit formation of polysiloxane by means of hydrolysis with water and condensation. Among other hydrolyzable groups mentioned above, $C_1$~$C_5$ alkoxy groups such as methoxy group, ethoxy group, and propoxy group and also acyloxy group prove advantageous, and methoxy group, ethoxy group, or propoxy group proves particularly advantageous. A $C_1$~$C_5$ alkoxy group or an acyloxy group is an appropriate choice for X because the compound formed as a by-product when the compound represented by the general formula (Ib) mentioned above is hydrolyzed and condensed can be easily removed from the reaction system and does not easily persist as an impurity.

The symbol $R^6$ in the general formula (Ib) mentioned above stands for a $C_1$~$C_{20}$ organic group. The organic groups denoted by this symbol include $C_1$~$C_{20}$ alkyl groups such as methyl group, ethyl group, and propyl group; $C_1$~$C_{20}$ aryl groups (inclusive of alkylaryl groups) such as phenyl group and methylphenyl group; and radical polymerizable group-containing $C_2$~$C_{20}$ groups such as acryloxyalkyl groups, methacryloxyalkyl groups, vinyl group, isopropenyl group, 1-alkenyl groups, and isoalkenyl groups; and may be further possessed of such substituents as glycidoxy group, mercapto group, and amino group. At least one group selected from the class consisting of $C_1$~$C_{10}$ alkyl groups, alkenyl groups, and aryl groups which are allowed to contain substituent(s). is an appropriate choice for $R^6$ in that it is capable of further improving hydrophobicity or corona charge retaining ratio.

When the symbol n in the general formula (Ib) mentioned above is 2, the two substituents $R^6$'s may be identical with or different from each other. When the symbol n is 3, the three substituents $R^6$'s may be different from one another or two or more $R^6$'s may be identical with one another. When 4-n is 2, the two X's may be identical with or different from each other. When 4−n is 3, the three X's may be different from one another or two or more X's may be identical with one another. When 4−n is 4, the four X's may be different from one another or two or more X's may be identical with one another.

The following compounds may be cited as concrete examples of the compound represented by the general formula (Ib) mentioned above. However, the compound of the general formula (Ib) is not limited to such non-exhaustive examples.

The compounds of the general formula (Ib) satisfying n=0 include tetraalkoxy silane compounds such as tetramethoxy silane, tetraethoxy silane, tetraisopropoxy silane, tetrabutoxy silane, and dimethoxydiethoxy silane, tetrabutoxy silane, and dimethoxydiethoxy silane; and tetraacyloxy silane compounds such as tetraacetoxy silane, for example.

The compounds of the general formula (Ib) satisfying N=1 include organotrialkoxy silane compounds and organotriacyloxy silane compounds such as methyltrimethoxy silane, methyltriethoxy silane, mehtyltriporpoxy silane, ethyltrimethoxy silane, ethyltriethoxy silane, propyltriethoxy silane, butyltrimethoxy silane, vinyltrimethoxy silane, vinyltriethoxy silane, 3-glyoidoxypropyl trimethoxy silane, 3-mercaptopropyltrimethoxy silane, 3-(2-aminoethylaminopropyl) trimethoxy silane, phenyl trimethoxy silane, phenyl triethoxy silane, 1-hexenyl trimethoxy silane, 1-octenyl trimethoxy silane, γ-methacryloxypropyltrimethoxy silane, γ-methacryloxypropyl triethoxy silane, γ-acryloxypropyl trimethoxy silane, γ-acryloxypropyl triethoxy silane, methyltriacetoxy silane, phyenyltriacetoxy silane, and γ-methacryloxypropyl triacetoxy silane, for example.

The compounds of the general formula (Ib) satisfying n=2 include diorganodialkoxy silane compounds and diorganodiacyloxy silane compounds such as dimethoxydimethyl silane, diethoxy-3-glycidoxy propylmethyl silane, dimethoxy diphenyl silane, diacetoxy dimethyl silane, diphenyl dimethoxy silane, bis(γ-acryloxypropyl) dimethoxy silane, bis(γ-methacryloxypropyl) dimethoxy silane, γ-methacryloxypropylethyl dimethoxy silane, γ-methacryloxypropylethyl diethoxy silane, γ-acryloxypropylethyl dimethoxy silane, γ-acryloxypropylethyl diethoxy silane, dimethyldiacetoxy silane, and phenylmethyldiacetoxy silane, for example.

The compounds of the general formula (Ib) satisfying n=3 include triorganoalkoxy silane compounds and triorganoacyloxy silane compounds such as trimethylmethoxy silane, tris(γ-acryloxypropyl) ethoxy silane, tris(γ-methacryloxypropyl) methoxy silane, tris(γ-methacryloxypropyl) ethoxy silane, bis(γ-acryloxypropyl) vinylmethoxy silane, bis(γ-methacryloxypropyl) vinylmethoxy silane, γ-acryloxypropyl diethylmethoxy silane, γ-acryloxypropyl diethylethoxy silane, γ-methacryloxypropyldiethyl methoxy silane, γ-methacryloxypropyldiethyl ethoxy silane, and acetoxytrimethyl silane, for example.

The derivaties of these compounds include those compounds in which β-dicarbonyl groups and/or other groups capable of forming a chelating compound are substituted for part of the X groups possessed by the compounds represented by the general formula (Ib) and those low condensates obtained by partially hydrolyzing and condensing the compounds represented by the general formula (Ib) and/or chelating compounds thereof, for example.

In this invention, it is preferable to use mainly the compounds, $SiX_4$, of the general formula (Ib) satisfying n=0 and/or the compounds, $R^6SiX_3$, of the general formula (Ib) satisfying n=1 among other silicon compounds mentioned above, more preferable to use essentially the compounds, $R^6SiX_3$, for the sake of imparting such necessary properties as hardness, mechanical strength, and hydrophobicity to the produced organic-inorganic composite particles, and particularly preferable to use such silicon compounds as form of a mixtures of SiX4 and $R^6SiX_3$ at a ratio of 1 to 70 ml % of $SiX_4$ to 99 to 30 mol % of $R^6SiX_3$.

In the silicon compounds represented by the general formula (Ib), particularly appropriate examples of the compound, $SiX_4$, satisfying n=0 are tetremethoxy silane, tetraethoxy silane, and low condensates thereof; and those of the compound, $R^6SiX_3$, satisfying n=1 are vinyl trimethoxy silane, vinyl triethoxy silane, methyl trimethoxy silane, methyl triethoxy silane, ethyl trimethoxy silane, ethyl triethoxy silane, phenyl trimethoxy silane, and low condensates thereof.

When the organic-inorganic composite particles to be produced are expected to be possessed of a positive charge property, it is advantageous to use such silicon compounds of the general formula (I) as incorporate partially or wholly therein an amino group-containing organic group as $R^6$ (providing that when n is 2 or more, at least one of the plurality of $R^6$'s may be an amino group-containing organic group and the remainder may be an organic group containing no amino group). As concrete examples of the silicon compound (A) containing an amino group, 3-(2-aminoethylaminopropyl) diemthoxymethyl silane, 3-ureidopropyl triethoxy silane, 3-aminopropyl triethoxy silane, 3-dimethylaminopropyl triethoxy silane, 3-(2-aminoethylaminopropyl) triemethoxy silane, 3-aminopropyl trimethoxy silane, 3-diemthylaminopropyl trimethoxy silane, 3-diethylaminopropyl trimethoxy silane, aminophenyl trimethoxy silane, N-phenyl-3-aminopropyl trimethoxy silane, and N-phenyl-3-aminopropyl triethoxy silane may be cited, but not limited thereto.

In the polymer which has a group represented by the general formula (II) mentioned above, the silicon atom which is combined to the organic polymer framework has one to three hydrolyzable groups, Y's.

The polymer incorporates therein preferably two or more, more preferably three or more, and still more preferably five or more groups represented by the general formula (II) in that the ease with which the polymer is contained in the particles grows in proportion as the number of these groups increases.

Appropriately, the hydrolyzable group Y is one monovalent group selected from the class consisting of halogen atoms, alkoxy group, and acyloxy groups. These hydrolyzable groups, when hydrolyzed with water and further condensed, permit formation of a polysiloxane. Further, preferable examples of the hydrolyzable group Y in the general formula (II) mentioned above are $C_1$~$C_5$ alkoxy groups such as methoxy group, ethoxy group, and propoxy group. When the hydrolyzable group Y is a $C_1$~$C_5$ alkoxy group, the compound formed as a by-product during the cohydrolysis and polycondensation of the silicon compound mentioned above and the polymer having this group of the general formula (II) can be easily removed from the reaction system.

The symbol $R^7$ in the general formula (II) mentioned above, similarly to the symbol $R^6$ in the general formula (Ib) mentioned above, denotes a $C_1$~$C_{20}$ organic group. The organic groups represented thereby include $C_1$–$C_{20}$ alkyl groups such as methyl group, ethyl group, and propyl group; $C_1$~$C_{20}$ aryl groups (inclusive of alkylaryl groups) such as phenyl group and methylphenyl group; and radical polymerizable group-containing $C_2$~$C_{20}$ groups such as acryloxyalkyl groups, methacryloxyalkyl groups, vinyl group, isopropenyl group, 1-alkenyl groups, and isoalkenyl groups; and may be further possessed of such substituents as glycidoxy group, mercapto group, and amino group.

When the symbol l in the general formula (II) mentioned above is 2, two $R^7$'s may be different from or identical with each other. When 3–l is 2, two Y's may be different from or identical with each other. When 3–l is 3, three Y's may be different from one another or two or more Y's may be identical with each other.

The polymer which is possessed of a group represented by the general formula (II) mentioned above is not restricted by such factors of the polymer as the molecular weight, the composition, the framework structure as to main chain, side chain, branched chain, and cross-linked chain, and the presence or absence of a functional group so long as it is possessed of the said relevant group and, at the same time, contains an organic polymer framework. The organic polymer framework, for example, is at least one member selected from the group consisting of poly(meth)acrylic esters, polystyrene, polyvinyl chloride, polyvinyl acetate, polyolefins, and polyesters, but not limited thereto. A preferred choice of the organic polymer framework is one which is possessed of a main chain formed of repeating —C—C— units.

The polymer which is possessed of a group represented by the general formula (II) as described above appropriately is what is obtained by homopolymerizing at least one radically polymerizable group-containing, hydrolyzable and polymerizable silicon compound selected from the group consisting of the compounds represented by the following general formula (III) and derivatives thereof, or copolymerizing the silicone compound with a copolymerizable organic monomer.

$$R^8_pSiY_{4-p} \quad \text{(III)}$$

(wherein $R^8$ stands for a radically polymerizable organic group of $C_2$~$C_{20}$, Y for a hydrolyzable group, and p for an integer in the range of 1 to 3, providing that when p is 2 or more, one of the plurality of $R^8$'s is a radically polymerizable organic group of $C_2$~$C_{20}$ and the remainder is a $C_1$~$C_{20}$ organic group containing no radically polymerizable group).

Concrete examples of the hydrolyzable group Y are the same as those cited with respect to the hydrolyzable group Y in the general formula (II) mentioned above.

The symbol $R^8$ in the general formula (III) mentioned above embraces such radically polymerizable organic group of $C_2$~$C_{20}$ groups such as acryloxyalkyl groups, methacryloxyalkyl groups, vinyl group, isopropenyl groups, 1-alkenyl groups, and isoalkenyl groups, but it is not limited thereto. A preferred choice of the group $R^8$, is at least one of the groups represented by the following formulas.

$$CH_2{=}CH{-} \quad \text{(a)}$$

(b)

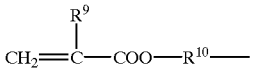

(wherein $R^9$ stands for a hydrogen atom or a methyl group and $R^{10}$ for a $C_1$~$C_{10}$ alkylene group)

(c)

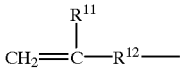

(wherein $R^{11}$ stands for a hydrogen atom or a methyl group and $R^{12}$ for a phenylene group of a $C_1$~$C_{10}$ alkylene group).

When p in the general formula (III) mentioned above is 2 or more, one of the plurality of $R^8$'s is a radically polymerizable group, i.e. a $C_1$~$C_{20}$ and the remainder is a $C_1$~$C_{20}$ organic group containing no radically polymerizable group, i.e. a $C_1$~$C_{20}$ alkyl group such as methyl group, ethyl group, or propyl group or a $C_1$~$C_{20}$ aryl group (inclusive of alkylaryl group) such as phenyl group, methylphenyl group. The groups enumerated above may be possessed of such a substituent as glycidoxy group, mercapto group, or amino group.

When 4-p in the general formula (II) mentioned above is 2 or more, the plurality of Y's may be different from or identical with one another.

An concrete examples of the compound represented by the general formula (III), vinyl trimethoxy silane, vinyl triethoxy silane, γ-methacryloxypropyl trimethoxy silane, γ-methacryloxypropyl triethoxy silane, γ-acryloxypropyl trimethoxy silane, γ-acryloxypropyl triethoxy silane, γ-methacryloxypropyl triacetoxy silane, γ-methacryloxypropylethyl dimethoxy silane, γ-methacryloxypropylethyl diethoxy silane, γ-acryloxypropylethyl dimethoxy silane, γ-acryloxypropylethyl diethoxy silane, γ-acryloxypropyldiethyl methoxy silane, γ-acryloxypropyldiethyl ethoxy silane, γ-methacryloxypropyldiethyl methoxy silane, γ-methacryloxypropyldiethyl ethoxy silane, 1-hexenyl trimethoxy silane, and 1-octenyl trimethoxy silane may be cited, but not limited thereto. Among other compounds mentioned above, those which have any of the groups represented by the formulas (a), (b), and (c) mentioned above and satisfy p=1 prove particular appropriate. As concrete examples of the compound answering this description, vinyl trimethoxy silane, vinyl triethoxy silane, γ-methacryloxypropyl trimethoxy silane, γ-methacryloxypropyl triethoxy silane, γ-acryloxypropyl trimethoxy silane, γ-acryloxypropyl triethoxy silane, and 1-hexenyl trimethoxy silane may be cited.

The organic monomer which is copolymerizable with the radically polymerizable group-containing, hydrolyzable and condensable silicon compound selected from the group consisting of the compounds represented by the general formula (III) and the derivative thereof is not particularly defined. As concrete examples of the organic monomer which answers this description, unsaturated carboxylic acids such as acrylic acid and methacrylic acid; unsaturated carboxylic esters such as acrylic esters, methacrylic esters, crotonic esters, itaconic esters, maleic esters, and fumaric esters; acryl amines; methacryl amides; aromatic vinyl compounds such as styrnee, α-methyl styrene; vinyl esters such as vinyl acetate; and vinyl compounds such as vinyl chloride and other halogenated vinyl compounds may be cited. These organic monomers may be used either singly or in the form of a mixture of two or more members. Among other organic monomers mentioned above, acrylic esters, methacrylic esters, aromatic vinyl compounds, and vinyl esters prove particularly appropriate.

The ratio at which the organic monomer and the radically polymerizable group-containing, hydrolyzable and condensable silicon compound selected from the group consisting of the compounds represented by the general formula (III) and the derivative thereof are used during the course of the oopolymerization thereof appropriately is such that the organic monomer accounts for a proportion in the range of 1 to 50 mol % based on the total amount of all the monomers used.

In order for the organic-inorganic composite particles to be produced as vested with a positive charge property, it is proper that a silicon compound containing such a positive charging group as amino group or ureido group, in the same manner as described with respect to the silicon compound (A), form part or the whole of the polymer framework which is possessed of the group represented by the general formula (III).

The organic-inorganic composite particles are produced by a method which comprises a step of partially or wholly hydrolyzing at least one hydrolyzable and condensable silicon compound selected from the group consisting of compounds represented by the general formula (Ib) mentioned above and derivatives thereof in the presence of an acid, thereby forming a hydrolyzate and/or a condensate thereof, and a step of polycondensing the hydrolyzate and/or the condensate thereof in the presence of a base, and performs either or both of the hydrolyzing step and the polycondensing step in the presence of a polymer containing a group represented by the general formula (II) mentioned above.

Appropriately, the mixing ratio of the polymer to the silicon compound is such that the proportion of the polymer is in the range of 0.1 to 100 parts by weight, preferably in the range of 0.2 to 50 parts by weight, and more preferably in the range of 0.5 to 30 parts by weight, based on 100 parts by weight of the silicon compound. If the proportion of the polymer is less than 0.1 part by weight, the produced particles will manifest no sufficient mechanical strength. Conversely, if this proportion exceeds 100 parts by weight, the produced particles will possibly undergo agglomeration.

In the first step of hydrolysis, the acid destined to serve as a catalyst is dissolved in an excess amount of water and is used in the form of an aqueous solution.

The acid catalyst to be used in the step of hydrolysis is similar to the acid catalyst described in the previous section tilted "Method 2 for production of organic-inorganic composite particles."

The solvent for the acid catalyst permits presence therein of an organic solvent besides water and the acid catalyst. The concrete examples of this organic solvent are similar to those organic solvents cited in the previous section titled "Method 1 for production of organic-inorganic composite particles."

This step of hydrolysis is implemented, for example, by adding a silicon compound represented by the general formula (Ib) mentioned above, optionally in combination with a polymer possessed of a group represented by the general formula (III) or a solution of the polymer in an organic solvent, to a medium containing water and stirring them together at a temperature in the range of 0 to 100° C., preferably 0 to 70° C., for a period in the range of 30 minutes to 100 hours. Appropriately, at the step of hydrolysis, the total concentration of the silicon compound of the general formula (Ib) and the optionally added polymer containing the group of the general formula (II) is in the range of 10 to 80% by weight, the concentration of water in the range of 10 to 80% by weight, and the concentration of the acid catalyst in the range of 0.001 to 1% by weight.

The second step of polycondensation is carried out in the aqueous solution of a base, or a mixture of the aqueous solution of a base and an organic solvent. The additional use of the organic solvent at the second step proves advantageous in that it permits production of minute composite particles without entailing agglomeration. At the second step, the reaction of polycondensation is effected by placing the aqueous solution of the base or a mixture thereof with an organic solvent to a reaction vessel, then adding to this reaction vessel an aqueous solution of the hydrolyzate and/or the condensate thereof obtained at the first step or a solution obtained by diluting the aqueous solution further with water and/or an organic solvent, and optionally further adding thereto a polymer containing a group represented by the general formula (III), and stirring the contents of the reaction vessel thereby exposing the hydrolyzate and/or the condensate thereof obtained at the first step (in combination with the optionally added polymer) to the base. Incidentally, the method for the addition of the aqueous solution of the hydrolyzate and/or the condensate thereof obtained at the first step to the aqueous solution of the base and the speed of this addition are not particularly critical. They may be suitably decided by such factors as the kind of the silicon compound used, the composition of the aqueous solution of the base, and particularly the presence or absence of an organic solvent.

The base catalyst to be used for the polycondensation of the hydrolysis and/or the condensate thereof obtained at the step of hydrolysis is similar to the base catalyst described in the previous section titled "Method 2 for production of organic-inorganic composite particles."

Appropriately, at this step of polycondensation, the concentration of water is in the range of 10 to 99% by weight and that of the base catalyst in the range of 0.01 to 10% by weight and the reaction temperature is in the range of 0 to 50° C.

The organic-inorganic composite particles which are formed by the hydrolysis and the polycondensation of at least one hydrolyzable and condensable silicon compound selected from the group consisting of the compounds represented by the general formula (Ib) mentioned above and the derivatives thereof and a polymer containing a group represented by the general formula (II) mentioned above are isolated from the slurry by any of the known methods such as filtration, centrifugation, reduced-pressure concentration, spray drying or instantaneous vacuum drying, then optionally washed, and subsequently subjected to a heat treatment for drying and firing in air or in an ambience of nitrogen at a temperature not exceeding 800° C., preferably falling in the range of 100 to 600° C., more preferably in the range of 150 to 500° C., and most preferably in the range of 200 to 450° C., to obtain organic-inorganic composite particles possessed of suitable charging properties and necessary mechanical properties such as suitable hardness as contemplated by this invention.

The organic-inorganic composite particles which are obtained by subjecting the silicon compound of the general formula (Ib) and the polymer containing the group represented by the general formula (II) jointly to the hydrolysis and the polycondensation as described above generally have a negative charge property (unless a silicon compound and/or a polymer containing a positively charging group such as in amino group are used as described previously). The methods described in the previous section titled "Method 1 for production of organic-inorganic composite particles" are similarly applicable herein for disposing of the hydroxyl group persisting on the surface of the organic-inorganic composite particles, for the surface treatment used for adjusting the amount of negative charge, and for the formation of organic-inorganic composite particles possessed of a positive charge property.

Electrostatic image developer

The electrostatic image developer of this invention comprises toner particles containing (a) a binding resin destined to serve as a binder and (b) a coloring agent; and (c) specific organic-inorganic composite particles which are attached or fixed to the surface or to the proximity of surface of the toner particles as mentioned above, namely organic-inorganic composite particles containing an organic polymer framework and a polysiloxane framework, the polysiloxane framework containing in the molecule thereof an organosilicon having a silicon atom to which at least one carbon atom in the organic polymer framework is combined directly, and the organic-inorganic composite particles having a mean particle diameter in the range of 0.01 to 5 $\mu$m, the organic-inorganic composite particles having $SiO_2$ as a component of the polysiloxane framework at a content in the range of 10 to 90% by weight.

The toner particles contains the binding resin and the coloring agent as essential components. Optionally, in addition thereto, it may suitably incorporate therein one or more additives which are normally used for toners of the ordinary run. As the additives, for example, an offset preventing agent and a charge controlling agent may be cited, but not limited thereto. When the developer is produced as one-component type, the toner particles further add magnetic particles as conventionally known. The mean particle diameter of the toner particles is not particularly critical. Appropriately, it is not more than 25 $\mu$m, falling preferably in the approximately range of 1 to 25 $\mu$m and more preferably in the range of 3 to 20 $\mu$m.

The binding resin and the coloring agent, and the offset preventing agent and the magnetic particles as well which are used as the components of the toner particles mentioned above are not particularly defined. They can be suitably selected from various substances of relevant types which have been in popular use in the field of toners.

As concrete unrestrictive examples of the binding resin, styrene type polymers, (meth)acrylic acid type or (meth) acrylic ester type polymers, polyolefin type polymers, polyester type polymers, polyurethane type polymers, polyamide type polymers, and epoxy type polymers may be cited. These polymers may be used either singly or in the form of a mixture of two or more members.

As concrete unrestricted examples of the coloring agent, carbon black, phthalocyanine type pigments, azo type pigments and dyes, nigrosine type dyes, and body pigments may be cited. These coloring agents may be used either singly or in the form of a mixture of two or more members. As concrete examples of the magnetic particles, powders of ferromagnetic metals such as iron, cobalt, and nickel; and particles of magnetite, hematite, and ferrite may be used. The magnetic particles have colors and, therefore, function also as a coloring agent. As a coloring agent in the production of the one-component developer, therefore, they can be used either independently or in combination with a coloring agent which is not in the form of magnetic particles.

The coloring agent such as carbon black is appropriate in that this coloring agent, when subjected to a graft treatment for surface improvement with a polymer such as a hydrophilic polymer, manifests high dispersibility in toner particles.

As concrete unrestrictive examples of the offset preventing agent, polyolefin waxes such as low molecular polyethylene and polypropylene; and natural waxes such as paraffin wax and carnauba wax may be cited.

The mixing ratio of (b) the coloring agent to (a) the binding resin in the toner particles is 20 to 2 parts by weight of (b) the coloring agent to 80 to 98 parts by weight of (a) the binding resin, as the total amount of (a) and (b) equals to 100 parts. Preferably this mixing ratio is 15 to 4 parts by weight of (b) the coloring agent to 85 to 96 parts by weight of (a) the binding resin. If the proportion of the coloring agent is notably smaller than the lower limit defined above, the produced image will acquire no sufficient density. Conversely, if this proportion is notably larger than the upper limit defined above, the produced image will have no sufficient fixing property.

The method for the production of the toner particles of this invention is not particularly defined. Various methods such as the pulverizing method, suspension polymerization method, and emulsion polymerization method are available for the production.

The mixing ratio of the organic-inorganic composite particles to the toner particles mentioned above appropriately is such that the proportion of the organic-inorganic composite particles falls in the range of 0.01 to 20 parts by weight, more preferably in the range of 0.05 to 5 parts by weight, and most preferably in the range of 0.1 to 3 parts by weight, based on 100 parts by weight of the toner particles containing (a) the binding resin and (b) the coloring agent at the prescribed ratio mentioned above. If this proportion is less than 0.01 part by weight, the produced toner particles will be deficient in fluidity and transferring property. Conversely, if the proportion exceeds 20 parts by weight, the produced toner particles will suffer decline of such properties as fixing property, transferability, and fluidity and, at the same time, allows preparation of a developer only with difficult.

The method for the addition of the organic-inorganic composite particles to the toner particles may be the so-called inner addition type aimed at distributing the added composite particles inside of the toner particles including at least the proximity of surface thereof, or the so-called outer addition type aimed at causing the composite particles to adhere or fix to the surface area of the toner particles. The inner addition can be effected as widely known by adding the organic-inorganic composite particles to the components of the toner particles, such as the binding resin and the coloring agent, when they are melted and mixed during the manufacture of the toner particles such as, for example, by using pulverizing method. The outer addition can be carried out as widely known by stirring and mixing the toner particles and the organic-inorganic composite particles thereby inducing adhesion. When the stirring and mixing are done exerting a mechanical driving action and/or a thermal action on the mixture, etc., a fast binding between them can be ensured. The addition under discussion is not restricted in any way to these methods.

In order for the toner to ensure lasting manifestation of ideal fluidity, transferability, and charging property, the toner particles thereof require the relevant toner additive, i.e., the organic-inorganic composite particles, to exist on and near the surface of toner particles. The toner, as a result, enjoys enhanced fluidity on the sensitized surface and improved transferability due to effective repression of the possible surface defilement. The expression "the proximity of surface of toner particles" as used in the present specification refers to the portion of a toner particle separated from the center thereto toward the surface thereof by no less than r/2, preferably not less than 3r/4, wherein r stands for the radius of the toner particle, although this magnitude of separation depends on the diameters of the toner particles and the organic-inorganic composite particles.

When the electrostatic image developer according to this invention is of the two-component type, it is allowed to incorporate therein a so-called carrier besides the toner which has the organic-inorganic composite particles attached or fixed thereto. Even when the two-component type developer does not contain the carrier, it still constitutes one mode of the electrostatic image developer according to this invention.

The carrier is not particularly critical. Any of the known carriers can be used. As concrete examples of the carrier, particles of such ferromagnetic metals as iron, cobalt, and nickel, particles of magnetite, hematite, and ferrite, and coated carriers obtained by coating such particles with coating resins, preferably low surface energy resins such as silicon resin and fluorine resin may be cited. Of course, the carrier under discussion is not restricted to these concrete examples.

The electrostatic image developer of this invention, owing to the incorporation therein of the organic-inorganic composite particles, is enabled to acquire ideal fluidity, transferability, and charging property as described above. Thus, it is capable of producing a clear image free from fogging on an electrostatic image formed on a photoconductive element.

EXAMPLES

Now, this invention will be described more specifically below with reference to working examples. It should be noted that this invention is not limited to the following examples in any sense.

The mean particle diameter, $SiO_2$ content and corona charge attenuation indicated in the working examples and the controls were determined or evaluated by the following methods.

Mean particle diameter:

This magnitude was determined by actually measuring diameters (X) of 100 particles arbitrarily selected from the particles shown in an electron micrograph and computing the following formula using the results of the measurement.

$$\text{Mean particle diameter } (\overline{X}) = \frac{\sum_{i=1}^{n} Xi}{n}$$

$SiO_2$ content:

This magnitude was determined by accurately weighing out 5 g of particles, placing the sample in a crucible, firing the sample in open air at 1000° C., accurately weighing the residue of firing, and finding the oxide content of the residue by gravimetric analysis.

Charge retaining ratio 5 minutes after charging:

This magnitude was determined by the following method using a corona charge property measuring device based on the following principle.

(Principle)

The term "charge retaining ratio 5 minutes after charging" refers to the magnitude which is measured by a device illustrated in FIG. 1. As shown in FIG. 1, a corona charge property measuring device 1 is provided with a measuring part for charging a powder under treatment by corona discharge and detecting the surface potential consequently generated, a conveying part for conveying the powder under treatment, and a control part for controlling this device. The components of the device 1 are attached to or received by casings 2A, 2B, 2C, and 2D.

The measuring part is provided with a high voltage adjusting slidac 10, a neon transformer 11, a high voltage indicating voltmeter 13, a corona discharge electrode 30, a surface potential detector 31, and a high voltage grade diode 32.

Figure 4:
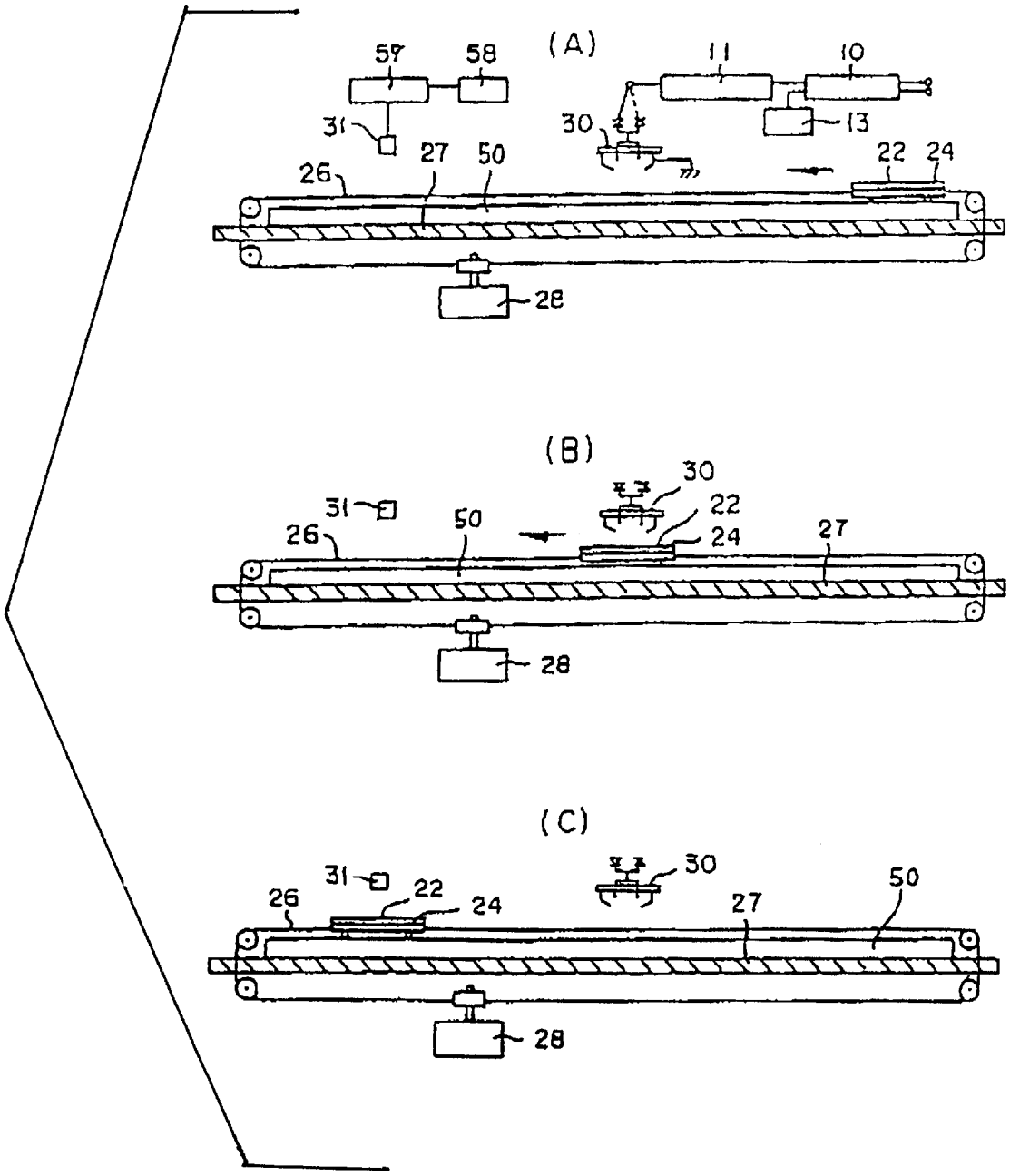
FIGS. 4(A)~(C) are plan views severally illustrating states of operation of the corona charging property measuring device during the measurement of the charge retaining ratio.

The high voltage adjusting slidac 10 is electrically connected to the primary side (inlet side) of the neon transformer 11 (FIG. 4). The slidac 10 is disposed inside the casing 2A which is positioned on the left lower side. The neon transformer 11 is disposed inside the casing 2B which is positioned on the left upper side.

When a voltage is introduced from an external power source through the slidac 10 to the primary side of the neon transformer 11, a high voltage (such as several kV, for example) raised proportionately to the ratio of transformation in the transformer 11 is emitted from the secondary side. A high voltage indicating lamp 14 glows while the inflow of power from the external power source continues and the lamp 14 ceases to glow when the inflow of the power from the external power source stops. A high voltage indicating lamp 15 glows while the emission of power from the secondary side of the transformer 11 continues and the lamp 15 ceases to glow when the emission of the power from the secondary side stops. The lamps 14 and 15 and the voltmeter 13 are set in place on the front panel of the casing 2B. The front panel is omitted from illustration to expose to sight the transformer 11 disposed inside. The voltmeter 13 is adapted to measure the magnitude of the voltage on the primary side of the neon transformer 11 and graduated so as to indicate the product value of the magnitude of voltage on the primary side multiplied by the ratio of transformation as the magnitude of voltage on the secondary side. The corona discharge voltage is adjusted with high accuracy by the slidac 10 based on the value indicated by the voltmeter 13. The corona discharge electrode 30 is disposed above the near center of the track of the conveying part inside the central casing 2D of the device 1 so as to discharge the corone directly downward.

A diode 32 is disposed outside the upper wall of the casing 2D, provided with a diode 32A for a forward direction and a diode 32B for a reverse direction, and adapted so that either of the diodes may be electrically interconnected between the corona discharge electrode 30 and the secondary side of the neon transformer 11 by means of a switch (not shown). The polarity of the charge of a powder 22 to be charged is selected by this switch. While the diode 32A remains in the connected state, the powder 22 to be charged is charged positively. While the diode 32B remains in the connected state, the powder 22 to be charged is charged negatively.

The surface potential detector 31 is disposed above one near end of the path of travel of the conveying part inside the casing 2D and provided at the lower end thereof with a shaking electrode (not shown). The surface potential detector 31 indirectly measures the surface potential of the charged powder 22 through the medium of the shaking electrode.

Figure 2:
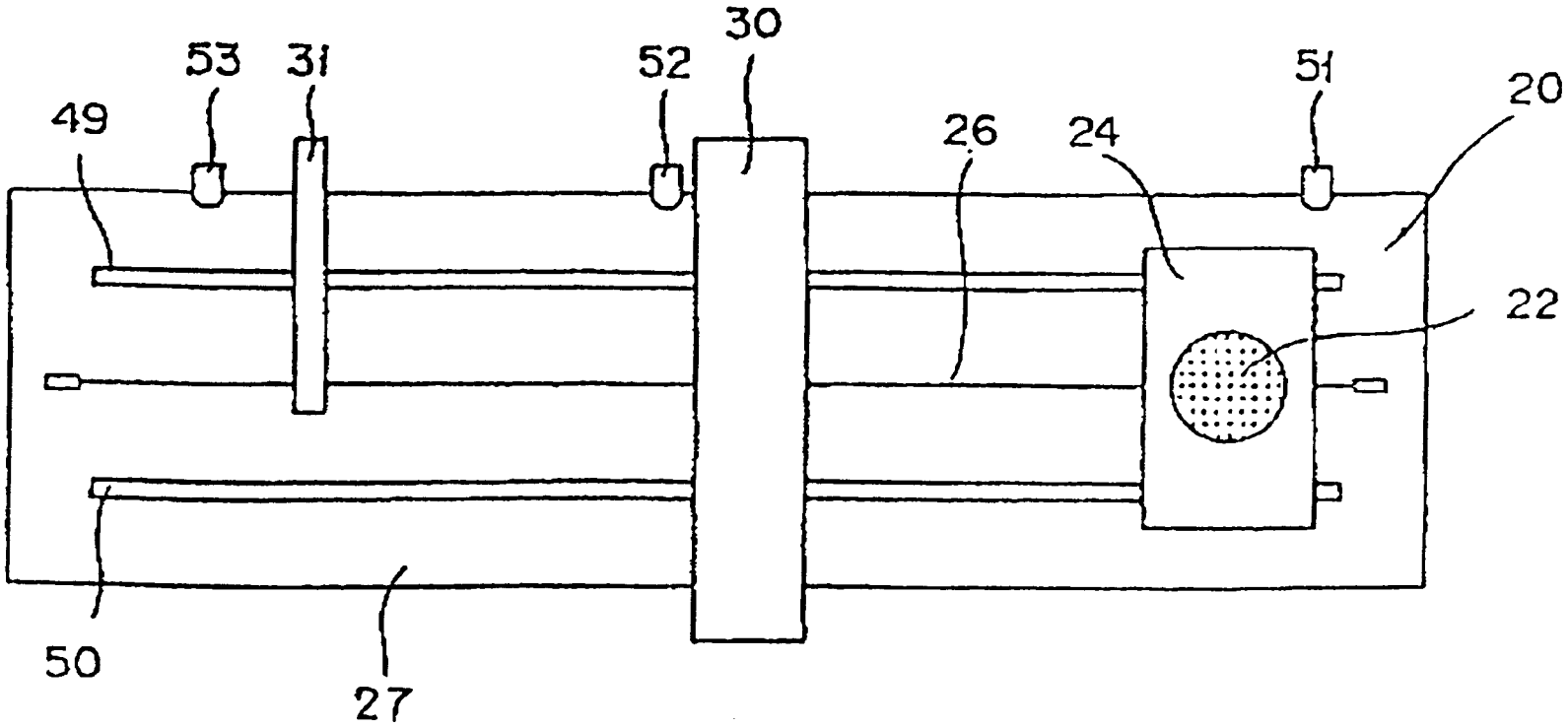
FIG. 2 is a plan view schematically illustrating the construction of a conveying mechanism in the corona charging property measuring device.

The conveying part is formed of a conveying mechanism 20 which is disposed at the generally central part of the device. The conveying mechanism 20, as sown in FIG. 2, is provided with a conveyor floor 27, a conveyor base 24, a moving wire 26, a drive motor 28, and two rails 49 and 50.

The conveyor floor 27 is disposed on the floor surface inside the casing 2D. On the conveyor floor 27, the two rails 49 and 50 are parallelly laid to form the track.

The conveyor base 24 serves the purpose of carrying the powder 22 to be charged on the upper side thereof and producing a reciprocating motion on the track by the fact that the wheels 24*a* attached to the lower side of the conveyor base 24 are rolled to and fro on the rails 49 and 50.

The moving wire 26 is adapted to form a closed loop stretched over and under the conveyor floor 27, attached to the conveyor base 24, and passed over the path of travel and hooked on pulleys disposed on the both sides of the track.

The drive motor 28 is attached to the upper wall surface of the casing 2A and adapted to impart a reciprocating motion to the wire 26. The drive motor 28 in this case is a stepping motor. An AC or DC servo motor is usable instead.

The casing 2D on the other end of the track is provided on the upper wall thereof with a door 3 through which the powder 22 to be charged is mounted on the conveyor base 24 or removed therefrom.

Figure 3:
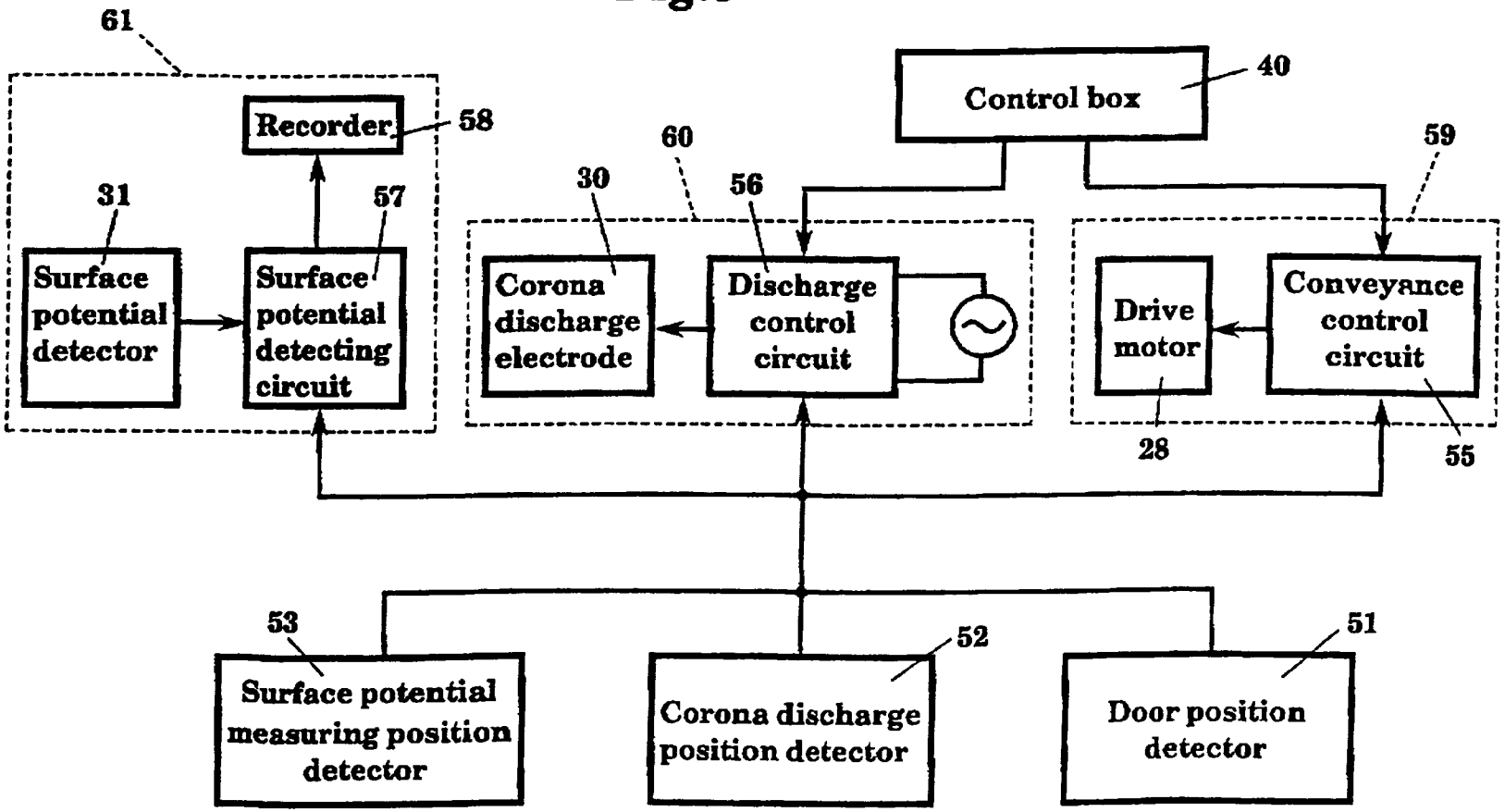
FIG. 3 is a circuit diagram schematically illustrating the construction of a control part for the corona charging property measuring device.

The control part, as shown in FIG. 3, is provided with a control box 40, a door position detector 51, a corona discharge position detector 52, a measuring position detector 53, a conveyance control circuit 55, a discharge control circuit 56, and a surface potential detecting circuit 57.

The control box 40 is disposed inside the casing 2C in the generally right lower part of the device 1, provided with a power source switch 41, a power source lamp 42 for indicating the operating condition of the power source switch 41, a high voltage switch 43 for applying a voltage to the corona discharge electrode 30, a lamp 44 for indicating the operating condition of the high voltage switch 43, an operating switch 45 for operating the conveyor base 24 for a motion to the right in the bearings of the diagram, a lamp 46 for indicating the operating condition of the operating switch 45, an operating switch 47 for operating the conveyor base 24 for a motion to the left in the bearings of the diagram, and a lamp 48 for indicating the operating condition of the operating switch 47, and adapted to be operated by an operator.

The door position detector 51 is a sensor disposed by the side of the rail 49 (or 50) at the other end of the track and adapted to emit a signal indicating detection of position when the conveyor base 24 assumes its position below the door 3 (home position).

The corona discharge position detector 52 is a sensor disposed by the side of the rail 49 (or 50) at the center of the track and adapted to emit a signal indicating detection of position when the conveyor base 24 assumes its position directly below the corona discharge electrode 30.

The control part is divided into a conveyance control block 59, a discharge control block 60, and a measurement control block 61.

The conveyance control block 59 is provided with the conveyance control circuit 55. The conveyance control circuit 55 controls the direction of rotation and the speed of rotation of the drive motor 28 in response to a conveyance signal from the control box 40. The conveyance signal is emitted when the operation switch 45 or the operation switch 47 is operated to the ON side. The drive motor 28 imparts a motion to the conveyor base 24 by causing the wire 26 to be moved by the conveyance signal.

The discharge control block 60 is provided with the discharge control circuit 56. When the high voltage switch 43 is turned on, the discharge control circuit 56 emits a corona discharge signal, injects a voltage into the primary side of the transformer 11, and induces the corona discharge electrode 30 to emit a corona discharge. Into the discharge control circuit 56 are injected the position detection signals which emanate from the door position detector 51, the corona discharge position detector 52, and the measuring position detector 53. The discharge control circuit 56 currently emitting a corona discharge signal, only when it is not engaged in receiving position detection signals from the detector 51 and the detector 53, stops the corona discharge after the currently continuing introduction of a position detection signal from the detector 52 has ceased. As a result, the corona discharge electrode 30 busy at corona discharge stops the corona discharge immediately after the conveyor base 24 has passed the point directly underlying this electrode 30.

The measurement control block 61 is provided with the surface potential measuring position detector 53, the surface potential detecting circuit 57, and a recorder 58. The surface potential detecting circuit 57 detects a surface potential signal from the surface potential detector 31 on the condition that is currently receiving a position detection signal from the detector 53. The recorder 58 records the detected surface potential signals in time series in the form of surface potentials. This recording is effected when the introduction of position detection signals from the detectors 51 and 52 is absent and the introduction of a position detection signal from the detector 53 is present, namely when the conveyor base 24 assumes its position below the surface potential detector 31.

The corona charge property measuring device constructed as described above is operated as follows to implement the measurement of the charge retaining ratio (FIG. 4).

First, the power source switch 41 is turned on. The high voltage switch 43 and the conveyance switches 45 to 47 are left off. The door 3 is opened and the powder 22 to be charged is placed on the conveyor base 24 positioned below the door 3. Then, the door is closed and the operation switch 47 is turned on. The conveyance control circuit 55, on receiving a conveyance signal emitted as prompted by the turn of the switch 47 toward the ON position, sets the drive motor 28 rotating in a prescribed direction. When the moving wire 26 is driven in consequence of the rotation of the motor 28, the conveyor base 24 is moved to the left (FIG. 4 (A)) and the door position detector 51 is induced to stop the emission of a position detection signal.

When the conveyor base 24 moved to the left passes under the corona discharge electrode 30 not engaged in corona discharge (FIG. 4 (B)) and reaches the point directly below the surface potential detector 31 as shown in FIG. 4 (C), the surface potential measurement position detector 53 emits a position detection signal, the conveyance control circuit 55 ceases to receive a conveyance signal, and the conveyor base 24 comes to a stop automatically directly below the surface potential detector 31. At this time, the surface potential measurement position detector 53 emits a position detection signal, the detectors 51 and 52 avoid emitting a position detection signal, the surface potential detector 31 emits a surface potential signal concerning the powder 22 to be charged treatment, and the surface potential detecting circuit 57 detects the surface potential signal. The recorder 58 records the detected surface potential signal as a surface potential A (V) after molding. The time which the conveyor base 24 spends in moving from the door position to the position of surface potential measurement is within one second.

After this record has been fulfilled, the operator turns the operation switch 45 on. The conveyance control circuit 55, on receiving a conveyance signal issued as prompted by the turn of the switch 45 toward the ON side, sets the drive motor 28 rotating in a prescribed direction. When the moving wire 26 is driven in consequence of the rotation, the conveyor base 24 moves to the right and the surface potential measurement position detector 53 ceases to emit a position detection signal. When the conveyor base 24 moved to the right passes under the corona discharge electrode 30 not engaged in corona discharge and reaches the point directly below the door 3 as shown in FIG. 4 (A), the door position detector 51 emits a position detection signal, the conveyance control circuit 55 ceases to receive a conveyance signal, and the conveyor base 24 automatically stops directly below the door 3.

Then, the incoming voltage on the primary side of the neon transformer 11 is adjusted by the slidac 10 so as to set the outgoing voltage on the secondary side thereof at 3.6 kV. The diode 32A for the forward direction (or the diode 32B for the reverse direction) is electrically interconnected by a switch (not shown) between the corona discharge electrode 30 and the secondary side of the neon transformer 11 so as to select the polarity of the charge of the powder 22 to be charged and turn the high voltage switch 43 on. After this operation has been fulfilled, the operator turns the operation switch 47 on to set the conveyor base 24 moving to the left. When the conveyor base 24 passes directly under the corona discharge electrode 30 currently engaged in corona discharge (FIG. 4 (B)), the powder 22 to be charged passes through the corona discharge and is instantaneously charged to the selected polarity. The corona discharge position detector 52 alone emits a position detection signal only when the conveyor base 24 passes directly under the corona discharge electrode 30. Thereafter, the high voltage switch 43 is automatically turned off and the corona discharge is completed.

When the conveyor base 24 which has passed directly below the corona discharge electrode 30 reaches the point directly below the surface potential detector 31 as shown in FIG. 4 (C), the door detector 51 and the corona discharge position detector 52 avoid emitting a position detection signal and the surface potential measuring position detector 53 alone emits a position detection signal. In consequence of the emission of this position detection signal, the conveyance control circuit 55 ceases to receive a conveyance signal and automatically stops directly below the surface potential detector 31 and, at the same time, the surface potential detector 31 emits a surface potential signal relative to the charged powder 22 which has been detected through the medium of a shaking electrode, the surface potential detecting circuit 57 detects the surface potential signal, and the recorder 58 records this detected surface potential signal in time series as the surface potential of the charged powder 22. The surface potential signal which is detected first corresponds to the surface potential $B_1$ (V) immediately after the corona charge and the surface potential signal detected five minutes thereafter to the surface potential $B_2$ (V) five minutes after the corona charge. The time which the conveyor base 24 spends in moving from the door position to the position of surface potential measurement is within one second.

For the purpose of moving the conveyor base 24 to the door position after the series of operations described above have been completed, it suffices to turn the operation switch 45 on.

The device is so adapted as to charge the powder to be charged selectively to either of the positive and the negative polarity arbitrarily and the corona discharge electrode and the surface potential detector are disposed as separated by a stated distance and are never allowed to operate simultaneously. Thus, the device is capable of accurately measuring charge properties of a given charged powder (state of time-course change of surface potential and attenuation property) without being affected by the disturbance due to noise, for example.

(Method of measurement)

In a metallic cell 7.6 cm in diameter and 0.5 cm in depth, powder to be charged molded in the shape of a disc 5 cm in diameter and 0.3 cm in height was set in place with the upper side of the disc laid in a horizon and left standing overnight at rest at 20° C. and 60% RH, the metallic cell was mounted on the conveyor vase and subjected to the measurement (with the voltage applied to the corona discharge electrode at the time of corona discharge set at 3.6 kV and the diode so set as the charge the powder to be charged to a negative or a positive polarity) in the device mentioned above to determine the surface potential (A) after the molding and the overnight standing, the surface potential ($B_1$) immediately after the corona charging, and the surface potential ($B_2$) five minutes after the corona charging. The charge retaining ratio five minutes after the charging was computed by the following formula using the magnitudes of surface potential consequently obtained. The measurement was carried out similarly in an ambience kept at 20° C. and 60% RH.

$$E = \frac{Q_3 - Q_1}{Q_2 - Q_1} \times 100(\%)$$
$$= \frac{CB_2 - CA}{CB_1 - CA} \times 100(\%)$$
$$= \frac{B_2 - A}{B_1 - A} \times 100(\%)$$

(wherein E stands for the charge retaining ratio (%) five minutes after the charging, $Q_1$ for the magnitude of charge after the molding and the overnight standing, $Q_2$ for the magnitude of charge immediately after the corona charging, $Q_3$ for the magnitude of charge five minutes after the corona charging, C for the electrostatic capacity of the powder to be charged, A for the surface potential (V) after the molding and overnight standing, $B_1$ for the surface potential (V) immediately after the corona charging, and $B_2$ for the surface potential (V) five minutes after the corona charging).

Example 1

In a solution (solution A) resulting from mixing 38 g of 25 wt % ammonium aqueous solution with 1722 g of water, a solution (solution B) resulting from mixing 36 G of vinyl trimethoxy silane with 120 g of methanol and 0.2 g of 2,2'-azobis (2,4-dimethylvaleronitrile) as a polymerization initiator was placed and treated to hydrolyze and condense the vinyl trimethoxy silane. Then, the resultant reaction mixture was heated in an ambience of $N_2$ at 70 to 75° C. for two hours to polymerize the vinyl group.

The reaction mixture was cooled and then centrifuged to separate a solid phase. This solid phase was vacuum dried at 50° C. to obtain composite particles (1).

The composite particles (1) were found to have a mean particle diameter of 0.35 μm and an $SiO_2$ content of 73.6 wt %.

When the particles (1) were tested for corona charge attenuation, they were found to have a charge retaining ratio of 98.2% five minutes after charging.

Then, a toner (1) of this invention was obtained by mixing 1 g of the composite particles (1) by the use of a Henschel mixer with 100 g of a toner having a mean particle diameter of 8~12 μm, resulting from dispersing carbon black as a coloring agent in a binding resin formed of a styrene-n-butyl acrylate copolymer.

When a commercially available copying machine was charged with this toner (1) and operated to produce 50,000 copies of a given original document, the images on the copies showed no sign of fogging. The magnitudes of charge at the outset and after the production of 50,000 copies were respectively −30 μC/g and −32 μC/g. When such copies were produced in an ambience of high temperature and high humidity (30° C. and 85% RH), the images on the copies were found perfect. The magnitude of charge under the conditions of high temperature and high humidity was −27 μC/g. The toner remaining on the sensitized surface showed fully satisfactory cleanability and neither inflicted any scratch on the sensitized surface nor covered it with a film.

Incidentally, a toner obtained without incorporating the composite particles (1) therein showed a magnitude of charge of −28 μC/g. This fact indicates that the incorporation of the composite particles (1) brought about no change in the magnitude of charge of the toner. The toner omitting the incorporation of the composite particles (1) was so deficient in fluidity that the toner feed part in the copying device was clogged. The toner remaining on the sensitized surface showed poor cleanability and often inflicted a scratch on the sensitized surface and covered it with a film.

Example 2

Composite particles (2) were obtained by following the procedure of Example 1 while using a solution resulting from mixing 18 g of 3-methacryloxypropyl trimethoxy silane with 60 g of methanol and 0.1 g of 2,2'-azobis(2,4-dimethyl valeronitrile) as a polymerization initiator instead as the solution B. The composite particles (2) thus obtained were found to have a mean particle diameter of 0.66 μm, an $SiO_2$ content of 32.1 wt %, and a charge retaining ratio five minutes after the charging of 68.3%.

Then, a toner (2) was obtained from the composite particles (2) and subjected to a continuous copying test in the same manner as Example 1. The results are shown in Table 1.

Example 3

Composite particles (3) were obtained by following the procedure of Example 1 while using a solution resulting from mixing 9 g of 3-methacryloxypropyl trimethoxy silane with 18 g of Ethyl Silicate 40 (a 4~5 mer of tetraethoxy silane having an $SiO_2$ content of 40 wt %, produced by Tama Kagaku K.K.), 75 g of methanol, and 0.1 g of 2,2'-azobis (2,4-dimethylvaleronitrile) as a polymerization initiator instead as the solution B. The composite particles (3) thus obtained were found to have a mean particle diameter of 0.24 μm, an $SiO_2$ content of 64.8 wt %, and a charge retaining ration five minutes after the charging of 51.4%.

Then, a toner (3) was obtained from the composite particles (3) and subjected to a continuous copying test in the same manner as in Example 1. The results are shown in Table 1.

Example 4

Composite particles (4) were obtained by following the procedure of Example 1 while using a solution resulting from mixing 38 g of 25 wt % aqua ammonia with 1722 g of water and 0.18 g of Hitenol N-08 (ammonium sulfate salt of polyoxyethylene nonylphenyl ether, produced by Dai-ichi Kogyo Seiyaku Co., Ltd.) instead as the solution A and a solution resulting from mixing 18 g of 3-methacryloxypropyl trimethoxy silane with 4 g of methyl methacrylate, 60 g of methanol, and 0.2 g of 2,2'-azobis(4-methoxy-2,4-dimethyl valeronitrile) instead as the solution B. The composite particles (4) thus obtained were found to have a mean particle diameter of 1.14 μm, an $SiO_2$ content of 26.2 wt %, and a charge retaining ratio five minutes after the charging of 37.3%.

Then, a toner (4) was obtained from the composite particles (4) and subjected to a continuous copying test in the same manner as in Example 1. The results are shown in Table 1.

Example 5

Composite particles (5) were obtained by following the procedure of Example 1 while using a solution resulting from mixing 18 g of 3-methacryloxypropyl trimethoxy silane with 120 g of methanol and 0.2 g of 2,2'-azobis(2,4-dimethyl valeronitrile) as a polymerization initiator instead as the solution B. The composite particles (5) thus obtained were found to have a mean particle diameter of 0.59 μm, an $SiO_2$ content of 52.3 wt %, and a charge retaining ratio five minutes after the charging of 78.5%.

Then, a toner (5) was obtained from the composite particles (5) and subjected to a continuous copying test in the same manner as in Example 1. The results are shown in Table 1.

Example 6

A slurry containing composite particles (6) was obtained by following the procedure of Example 1 while using a solution resulting from mixing 9 g of vinyl trimethoxy silane and 4 g of methyl trimethoxy silane with 120 g of methanol and 0.2 g of 2,2'-azobis(2,4-dimethyl valeronitrile) as a polymerization initiator instead as the solution B, and subsequently polymerizing the vinyl group. The composite particles (6) were obtained by spray drying the slurry at 180° C. The composite particles (6) thus obtained were found to have a mean particle diameter of 0.10 μm, an $SiO_2$ content of 80.4 wt %, and a charge retaining ratio five minutes after the charging of 94.5%.

Then, a toner (6) was obtained from the composite particles (6) and subjected to continuous copying test in the same manner as in Example 1. The results are shown in Table 1.

Example 7

Composite particles (7) were obtained by mixing 10 g of the composite particles (1) obtained in Example 1 with 0.5 g of 3-aminopropyl trimethoxy silane and 100 g of isopropyl alcohol, subjecting the resultant mixture to ultrasonic dispersion, heating and drying under a reduced pressure the resultant dispersion by the use of an evaporator, and further vacuum drying the dried particles at 50° C. The composite particles (7) thus obtained were found to have a mean particle diameter of 0.35 μm, an $SiO_2$ content of 72.9 wt %, and a charge retaining ratio five minutes after the charging of 91.3%. Then, a toner (7) was obtained by following the procedure of Example 1 while using 1 g of the composite particles (7) with 100 g of a toner having carbon black as a coloring agent and nigrosine as a charge controlling agent dispersed in a binding resin formed of a styrene—n-butyl acrylate copolymer and having a mean particle diameter of 10 to 15 μm and the toner (7) was subjected to a continuous copying test. The results are shown in Table 1. Incidentally, a toner obtained without using the composite particles (7) was found to have a magnitude of charge of +20 μC/g.

Example 8

Composite particles (8) were obtained by following the procedure of Example 4 while using the mixture of the solution B with 0.2 g of N-dimethylaminoethyl methacrylate instead. The composite particles (8) thus obtained were found to have a mean particle diameter of 1.09 μm and an $SiO_2$ content of 25.0 wt %, and a charge retaining ratio five minutes after the charging of 30.8%.

Then, a toner (8) was obtained from the composite particles (8) and subjected to a continuous copying test in the same manner as in Example 1. The results are shown in Table 1.

Example 9

Composite particles (9) were obtained by following the procedure of Example 6 while using the mixture of the solution B with 0.5 g of 3-(2-aminoethylaminopropyl) dimethoxymethyl silane instead. The composite particles (9) thus obtained were found to have a mean particle diameter of 0.12 μm, an $SiO_2$ content of 79.6 wt %, and a charge retaining ratio five minutes after the charging of 86.3%.

Then, a toner (9) was obtained from the composite particles (9) and subjected to a continuous copying test in the same manner as in Example 1. The results are shown in Table 1.

Control 1

A toner (11) using a polymethylsilsesquioxane powder (having a mean particle diameter of 0.32 μm; produced by Toshiba Silicone K. K. and marketed under trademark designation of "Tosperl 103") was obtained by following the procedure of Example 1 while using the polymethylsilsesquioxane powder in the place of the composite particles (1) and this toner (11) was subjected to a continuous copying test. The results are in Table 1. Because the polymethylsilsesquioxane powder was deficient in mechanical strength (fracture strength), the toner particles were crushed into minute particles of less than 0.05 μm in diameter during the course of mixing in the Henschel mixer. The images produced with the toner showed a sign of fogging. The toner remaining on the sensitized surface showed poor cleanability and inflicted a scratch to the sensitized surface and covered the surface with a film Control 2

A toner (12) using a hydrophobic colloidal silica (having a mean particle diameter of 0.016 μm; produced by Japan Aerosil Ltd. and marketed under trademark designation of "Aerosil R972") was obtained by following the procedure of Example 1 while using the hydrophobic colloidal silica in the place of the composite particles (1) and this toner (12) was subjected to a continuous copying test. The results are shown in Table 1.

TABLE 1

| | Test under Normal Condition | | | Test under High Temperature and High Humidity | | | | |
|---|---|---|---|---|---|---|---|---|
| | | Magnitude of Charge μC/g | | | | | | |
| | | | After | | | | | |
| | Fogging | Outset | Production of 50,000 copies | Fogging | Magnitude of Charge μC/g | Cleanability | Scratch on Sensitized Surface | Filming on Sensitized Surface |
| Example 1 | N.D. | −30 | −32 | N.D. | −27 | Good | N.D. | N.D. |
| Example 2 | N.D. | −29 | −28 | N.D. | −26 | Good | N.D. | N.D. |
| Example 3 | N.D. | −28 | −28 | N.D. | −25 | Good | N.D. | N.D. |
| Example 4 | N.D. | −28 | −27 | N.D. | −25 | Good | N.D. | N.D. |
| Example 5 | N.D. | −29 | −31 | N.D. | −26 | Good | N.D. | N.D. |
| Example 6 | N.D. | −31 | −30 | N.D. | −30 | Good | N.D. | N.D. |
| Example 7 | N.D. | +19 | +17 | N.D. | +18 | Good | N.D. | N.D. |
| Example 8 | N.D. | +19 | +18 | N.D. | +16 | Good | N.D. | N.D. |
| Example 9 | N.D. | +21 | +20 | N.D. | +17 | Good | N.D. | N.D. |
| Control 1 | N.D. | −24 | −20 | Occurred at 24000 copies | −19 | 6 troubles during 50000 copies | Yes | Yes |
| Control 2 | Occurred at 33000 copies | −23 | −11 | Occurred at 19000 copies | −10 | 2 troubles during 50000 copies | Yes | Yes |

Example 10

A clean solution was prepared by mixing 27 g of γ-methacryloxypropyl trimethoxy silane with 54 g of an aqueous 1500 ppm dodecylbenzenesulfonic acid solution and heating the mixture at 50° C. thereby hydrolyzing the γ-methacryloxypropyl trimethoxy silane. This solution was cooled and then mixed with 10 g of methanol and 0.14 g of azobis (2,4-dimethyl valeronitrile) to obtain solution B.

Separately solution A was prepared by mixing 141.1 g of water with 8.7 g of 25 wt % aqua ammonia. The solution A was kept stirred and the B solution was meanwhile added dropwise thereto over a period of 10 minutes to effect a reaction of polycondensation. The resultant reaction mixture was continuously stirred for another 20 minutes and then heated in an ambience of $N_2$ at 70° C.±5° C. to effect a reaction of radical polymerization. The reaction mixture was continuously heated for two hours and then cooled to normal room temperature. The suspension consequently obtained showed no sign of agglomeration. This suspension was filtered for solid-liquid separation. The cake resulting from the separation was washed with water and filtered three times and then vacuum dried at 150° C. for two hours to obtain composite particles (10).

The composite particles (10) thus obtained were found to have a mean particle diameter of 0.82 μm and an $SiO_2$ content of 33.8 wt %.

When the particles (10) were tested for corona charge attenuation, they were found to have a charge retaining ratio five minutes after the charging of 72.8%.

When a toner (13) was obtained by following the procedure of Example 1 while using the composite particles (10) instead and the toner (13) was subjected to a continuous copying test, the images on the produced copies were found to show no sign of fogging. The magnitudes of charge at the outset and after the production of 50,000 copies were respectively −29 μC/g and −32 μC/g. When such copies were produced in an ambience of high temperature and high humidity (30° C. and 85% RH), the images on the copies were found perfect. The magnitude of charge under the conditions of high temperature and high humidity was −26 μC/g. The toner remaining on the sensitized surface showed fully satisfactory cleanability and neither inflicted any scratch on the sensitized surface nor covered it with a film.

Examples 11 to 13

Composite particles (11)~(13) were obtained by following the procedure of Example 10 while using the silicon compounds indicated in Table 2 in the place of the γ-methacryloxypropyl trimethoxy silane. The results of analysis of these composite particles are shown in Table 2.

Toners (14)~(16) were obtained by following the procedure of Example 1 while using the composite particles (11)~(13) in the place of the composite particles (1) and these toners were subjected to a continuous copying test in the same manner as in Example 1. The results are shown in Table 3.

Example 14

Composite particles (14) were obtained by following the procedure of Example 10 while using the silicon compound indicated in Table 2 in the place of the γ-methacryloxypropyl trimethoxy silane. The results of analysis of these composite particles are shown in Table 2.

A toner (17) was obtained by following the procedure of Example 1 while using 1 g of the composite particles (14) with 100 g of a toner having carbon black as a coloring agent and nigrosine as a charge controlling agent dispersed in a binding resin formed of a styrene—n-butylacrylate copolymer and having a mean particle diameter of 10 to 15 μm and the toner (17) was subjected to a continuous copying test. The results are shown in Table 3. Incidentally, a toner obtained without using the composite particles (14) was found to have a magnitude of charge of +20 μC/g.

Control 3

A toner (18) using polymethyl methacrylate particles (having a mean particle diameter of 0.41 μm) was obtained by following the procedure of Example 10 while using the polymethyl methacrylate particles in the place of the composite particles (10) and this toner (18) was subjected to a continuous copying test. The results are shown in Table 3.

TABLE 2

| | Kind and Amount of Silicon Compounds | | Mean Particle Diameter (μm) | $SiO_2$ Content (%) | Charge Retaining Ratio (%) |
|---|---|---|---|---|---|
| Example 10 | γ-Methacryloxypropyl trimethoxy silane | 27 g | 0.82 | 33.8 | 73 |
| Example 11 | γ-Methacryloxypropyl trimethoxy silane | 17 g | 0.08 | 51.7 | 56 |
| | Tetramethoxy silane | 10 g | | | |
| Example 12 | γ-Acryloxypropyl trimethoxy silane | 7 g | 0.45 | 67.0 | 99 |
| | Vinyl trimethoxy silane | 20 g | | | |
| Example 13 | p-Vinyl phenyl trimethoxy silane | 20 g | 0.26 | 46.5 | 85 |
| | Tetramethoxy silane | 5 g | | | |
| Example 14 | γ-Methacryloxypropyl trimethoxy silane | 17 g | 0.14 | 45.4 | 62 |
| | Tetramethoxy silane | 6 g | | | |
| | γ-Amino propyl trimethoxy silane | 3 g | | | |

(determined after being vacuum dried at 150° C. for four hours) and a mean molecular weight by number of 13000 (as polystyrene; determined by GPC analysis).

Then, a clear solution was obtained by mixing 50 g (0.338 mol) of vinyl trimethoxy silane, 10 g (0.066 mol) of tetramethoxy silane, and 45 g of an aqueous 300 ppm dodecylbenzene sulfonic acid solution with 5 g of the polymer solution (solids content 2.45 g) obtained as described above and heating and stirring the resultant mixture at 50° C. for 30 minutes. This clear solution was cooled and then mixed with 40 g of methanol to obtain a hemogeneous clear solution, which was labeled as solution B.

Separately, solution A was prepared by mixing 500 g of water with 10 g of 25 wt % aqua ammonia. The solution A was kept stirred and the solution B was added dropwise thereto over a period of two hours to effect a reaction of polycondensation. The suspension consequently obtained was filtered for solid-liquid separation. The cake resulting from the separation was washed with water and filtered repeatedly and then fired in an ambience of $N_2$ at 250° C. for two hours to obtain composite particles (15).

The composite particles (15) thus obtained were found to have a mean particle diameter of 0.58 μm and an $SiO_2$ content of 76.0 wt %.

When the particles (15) were tested for corona charge attenuation, they were found to have a charge retaining ratio five minutes after the charging of 81%.

When a toner (19) was obtained by following the procedure of Example 1 while using the composite particles (15) instead and the toner (19) was subjected to a continuous copying test, the images on the produced copies were found to show no sign of fogging. The magnitudes of charge at the outset and after the production of 50,000 copies were respectively −28 μC/g and −30 μC/g. When such copies were produced in an ambience of high temperature and high humidity (30° C. and 85% RH), the images on the copies were found perfect. The magnitude of charge under the conditions of high temperature and high humidity was −26 μC/g. The toner remaining on the sensitized surface showed fully satisfactory cleanability and neither inflicted any scratch on the sensitized surface nor covered it with a film.

TABLE 3

| | Test under Normal Condition | | | Test under High Temperature and High Humidity | | | | |
|---|---|---|---|---|---|---|---|---|
| | | Magnitude of Charge μC/g | | | | | | |
| | | | After | | | | | |
| | Fogging | Outset | Production of 50,000 copies | Fogging | Magnitude of Charge μC/g | Cleanability | Scratch on Sensitized Surface | Filming on Sensitized Surface |
| Example 10 | N.D. | −29 | −32 | N.D. | −26 | Good | N.D. | N.D. |
| Example 11 | N.D. | −29 | −28 | N.D. | −25 | Good | N.D. | N.D. |
| Example 12 | N.D. | −30 | −28 | N.D. | −26 | Good | N.D. | N.D. |
| Example 13 | N.D. | −29 | −27 | N.D. | −27 | Good | N.D. | N.D. |
| Example 14 | N.D. | +19 | +18 | N.D. | +17 | Good | N.D. | N.D. |
| Control 3 | Occurred at 48000 copies | −25 | −20 | Occurred at 29000 copies | −18 | 3 troubles during 50000 copies | N.D. | Yes |

Example 15

A mixture of 50 g of γ-methacryloxypropyl trimethoxy silane with 50 g of methanol and 1 g of 2.2'-azobis(4-methoxy-2,4-dimethyl valeronitrile) as a radical polymerization initiator was heated in an ambience of $N_2$ at 60° C. for four hours to effect polymerization of the γ-methacryloxypropyl trimethoxy silane. This reaction of polymerization produced a polymer solution (15). This polymer (15) was found to have a solids content of 49%

Example 16

In the place of the solution B obtained in Example 15, a solution was prepared as follows and was labeled as solution B.

A clear solution was obtained by mixing 40 g (0.270 mol) of vinyl trimethoxy silane, 10 g (0.040 mol) of γ-methacryloxypropyl trimethoxy silane, 5 g (0.033 mol) of tetramethoxy silane with 45 g of an aqueous 300 ppm dodecylbenzenesulfonic acid solution and heating and stirring the resultant mixture at 50° C. for 30 minutes. This clear solution was cooled and the mixed with 40 g of methanol and 10 g (solids content 4.9 g) of the polymer solution (15) obtained in Example 15 to obtain a homogeneous clear solution. This solution was labeled as solution B.

Then, by following the procedure of Example 15, the solution A was kept stirred and the B solution was added dropwise thereto over a period of two hours to effect a reaction of polycondensation. The suspension thus obtained was spray dried for solid-liquid separation. The solid phase thus obtained was disintegrated by means of a jet mill and heated in an ambience of $N_2$ at 350° C. for two hours to obtain composite particles (16). These composite particles (16) were analyzed. The results are shown in Table 4.

A toner (20) was obtained by following the procedure of Example 1 while using the composite particles (16) in the place of the composite particles (1) and this toner was subjected to a continuous copying test in the same manner as in Example 1. The results are shown in Table 6.

Example 17

A mixture of 100 g of vinyl trimethoxy silane with 5 g of benzoyl peroxide as a radical polymerization initiator was heated in an ambience of $N_2$ at 80° C. for four hours to effect polymerization of the vinyl trimethoxy silane. This polymerization produced a polymer solution (17). This polymer solution was found to have a solid content of 15% and a mean molecular weight by number of 1200.

Then, a clear solution was obtained by mixing 50 g (0.338 mol) of vinyl trimethoxy silane and 5 g (0.033 mol) of tetramethoxy silane as silicon compounds with 45 g of an aqueous 300 ppm dodecylbenzenesulfonic acid solution and 5 g (solids content 0.75 g) of the polymer solution (17) obtained as described above and stirring the resultant mixture at 50° C. for 30 minutes. The clear solution was cooled and then mixed with 40 g of methanol to obtain a homogeneous clear solution, which was labeled as solution B.

Then, by following the procedure of Example 16, the solution A was kept stirred and the solution B was added dropwise thereto over a period of two hours to effect a reaction of polycondensation. The suspension thus obtained was spray dried for solid-liquid separation. The solid phase thus obtained was disintegrated by means of a jet mill and heated in an ambience of $N_2$ at 200° C. for two hours to obtain composite particles (17). These composite particles (17) were analyzed. The results are shown in Table 5.

A toner (21) was obtained by following the procedure of Example 1 while using the composite particles (17) in the place of the composite particles (1) and this toner was subjected to a continuous copying test in the same manner as in Example 1. The results are shown in Table 6.

Example 18

Composite particles (18) were obtained by following the procedure of Example 17 while preparing a solution B with a polymer solution (18) indicated in Table 4 in the place of the polymer solution (17) used in the preparation of the solution B in Example 17 and using such silicon compounds as shown in Table 4 instead. The composite particles (18) were analyzed. The results of this analysis are shown in Table 5.

A tone (21) was further obtained by following the procedure of Example 1 while using the composite particles (18) in the place of the composite particles (1) and the toner (21) was subjected to a continuous copying test in the same manner as in Example 1. The results are shown in Table 6.

Example 19

Composite particles (19) were obtained by following the procedure of Example 17 while preparing a solution B with a polymer solution (19) indicated in Table 4 in the place of the polymer solution (17) used in the preparation of the B solution in Example 17 and using such silicon compounds as shown in Table 4 instead. The composite particles (19) were analyzed. The results of this analysis are shown in Table 5.

A toner (22) was obtained by following the procedure of Example 1 while using 1 g of the composite particles (19) with 100 g of a toner having carbon black as a coloring agent and nigrosine as a charge controlling agent dispersed in a binding resin formed of a styrene—n-butyl acrylate copolymer and having a mean particles diameter of 10 to 15 μm and the toner (22) was subjected to a continuous copying test. The results are shown in Table 6. A toner obtained without using the composite particles (19) was found to have a magnitude of charge of +20 μC/g.

Control 4

Composite particles (C1) for comparison were obtained by following the procedure of Example 17 while preparing a solution B without using a polymer solution. The composite particles (C1) for comparison thus obtained were analyzed. The results of the analysis are shown in Table 5.

Then, a toner (23) using the composite particles (C1) for comparison was obtained by following the procedure of Example 1 while using the composite particles (C1) for comparison in the place of the composite particles (1) and this toner (23) was subjected to a continuous copying test. The results are shown in Table 6. Because the composite particles (C1) for comparison were deficient in mechanical strength (fracture strength), they were crushed into minute particles of less then 0.05 μm in diameter during the course of mixing in the Henschel mixer. The images produced with the toner showed a sign of fogging. The toner remaining on the sensitized surface showed poor cleanability and inflicted a scratch to the sensitized surface and covered the surface with a film.

TABLE 4

| | Polymer Solution | | | | | |
|---|---|---|---|---|---|---|
| | No. | Monomer composition (wt %) | Solid Content | Mean Molecular Weight by Number | Amount used in solution B (Solid Content) | Silicon compound Kind and amount (mol) |
| Example 15 | (15) | γ-Methacryloxy propyl trimethoxy silane (100%) | 49% | 13000 | 5 g (2.45 g) | Vinyl trimethoxy silane 50 g (0.338 mol) Tetra methoxy silane 10 g (0.066 mol) |
| Example 16 | (15) | ↑ | ↑ | ↑ | 10 g (4.9 g) | Vinyl trimethoxy silane 40 g (0.270 mol) γ-Methacryloxy propyl trimethoxy silane 10 g (0.040 mol) Tetra methoxy silane 5 g (0.033 mol) |
| Example 17 | (17) | Vinyl trimethoxy silane (100%) | 15% | 1200 | 5 g (0.75 g) | Vinyl trimethoxy silane 50 g (0.338 mol) Tetra methoxy silane 5 g (0.033 mol) |
| Example 18 | (18) | Vinyl trimethoxy silane (42%) Vinyloxy propyl trimethoxy silane (58%) | 31% | 2500 | 5 g (1.55 g) | Ethyl trimethoxy silane 25 g (0.167 mol) Vinyl trimethoxy silane 25 g (0.169 mol) Tetra methoxy silane 15 g (0.100 mol) |
| Example 19 | (19) | Vinyl trimethoxy silane (40%) Vinyl phenyl trimethoxy silane (60%) | 28% | 3300 | 5 g (1.4 g) | Vinyl trimethoxy silane 45 g (0.304 mol) γ-Amino propyl trimethoxy silane 5 g (0.028 mol) Tetra methoxy silane 5 g (0.033 mol) |
| Control 4 | — | — | — | — | — | Vinyl trimethoxy silane 50 g (0.338 mol) Tetra methoxy silane 5 g (0.033 mol) |

TABLE 5

| | No. of Composite Particles | Mean Particle Diameter (μm) | $SiO_2$ Content (wt %) | Charge Retaining Ratio Five Minutes after the Charging (%) |
|---|---|---|---|---|
| Example 15 | (15) | 0.58 | 76.0 | 81 |
| Example 16 | (16) | 0.82 | 63.7 | 83 |
| Example 17 | (17) | 0.37 | 78.1 | 95 |

TABLE 5-continued

| | No. of Composite Particles | Mean Particle Diameter (μm) | $SiO_2$ Content (wt %) | Charge Retaining Ratio Five Minutes after the Charging (%) |
|---|---|---|---|---|
| Example 18 | (18) | 0.08 | 77.2 | 74 |
| Example 19 | (19) | 0.21 | 72.5 | 69 |
| Control 4 | (C1) | 0.35 | 77.9 | 91 |

TABLE 6

| | Test under Normal Condition | | | Test under High Temperature and High Humidity | | | | |
|---|---|---|---|---|---|---|---|---|
| | | Magnitude of Charge μC/g | | | | | | |
| | Fogging | Outset | After Production of 50,000 copies | Fogging | Magnitude of Charge μC/g | Cleanability | Scratch on Sensitized Surface | Filming on Sensitized Surface |
| Example 15 | N.D. | −28 | −30 | N.D. | −26 | Good | N.D. | N.D. |
| Example 16 | N.D. | −28 | −29 | N.D. | −26 | Good | N.D. | N.D. |

TABLE 6-continued

| | Test under Normal Condition | | | Test under High Temperature and High Humidity | | | | |
|---|---|---|---|---|---|---|---|---|
| | | Magnitude of Charge μC/g | | | | | | |
| | | | After | | | | | |
| | Fogging | Outset | Production of 50,000 copies | Fogging | Magnitude of Charge μC/g | Cleanability | Scratch on Sensitized Surface | Filming on Sensitized Surface |
| Example 17 | N.D. | −30 | −32 | N.D. | −27 | Good | N.D. | N.D. |
| Example 18 | N.D. | −27 | −27 | N.D. | −25 | Good | N.D. | N.D. |
| Example 19 | N.D. | +18 | +17 | N.D. | +17 | Good | N.D. | N.D. |
| Control 4 | Occurred at 45000 copies | −25 | −20 | Occurred at 23000 copies | −18 | 5 troubles during 50000 copies | Yes | Yes |

What is claimed is:

1. An electrostatic image developer, which comprises:

toner particles comprising (a) a binding resin and (b) a coloring agent and having a mean particle diameter of not more than 25 μm; and (c) organic-inorganic composite particles which exist in a portion selected from the surface and the proximity of surface of said toner particles, in a state being one of attached and fixed, and wherein said composite particles comprise an organic polymer framework and a polysiloxane framework, wherein said polysiloxane framework comprises a three-dimensional network which is formed by continuous chemical bondage of siloxane units represented by the following formula:

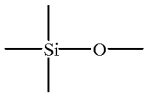

and said polysiloxane framework has in the molecule thereof, an organosilicon moiety which has a silicon atom to which at least one carbon atom in said organic polymer framework is combined directly, wherein said organic polymer framework comprises a main vinyl polymer chain formed of repeating units —C—C—, said organic-inorganic particles having $SiO_2$ as a component of said polysiloxane framework at a content in the range of 10 to 90% by weight, and said composite particles having a mean particles diameter in the range of 0.01 to 5 μm;

the mixing ratio of (b) said coloring agent to (a) said binding resin in said toner particles being 20 to 2 parts by weight of (b) said coloring agent to 80 to 98 parts by weight of (a) said binding resin, wherein the total amount of (a) and (b) is 100 parts; and the mixing ratio of said organic-inorganic composite particles to said toner particles being 0.01 to 20 by weight of said organic-inorganic composite particles to 100 parts by weight of said toner particles.

2. An electrostatic image developer according to claim 1, wherein said (c) organic-inorganic composite particles have $SiO_2$ which constitutes said polysiloxane framework at a content in the range of 25 to 85% by weight.

3. An electrostatic image developer according to claim 2, wherein (c) said organic-inorganic composite particles have a mean particle diameter in the range of 0.01 to 2 μm.

4. An electrostatic image developer according to claim 3, wherein the mixing ratio of (c) said organic-inorganic composite particles to 100 parts by weight of said toner particles is in the range of 0.1 to 3 parts by weight.

5. An electrostatic image developer according to claim 1, wherein (c) said organic-inorganic composite particles are obtained by a step of hydrolyzing and condensing radically polymerizable group-containing, hydrolyzable and condensable at least one silicon compound selected from the group consisting of compounds represented by the following general formula (I):

$$R^1_mSiX_{4-m} \quad (I)$$

(wherein $R^1$ stands for a radically polymerizable organic group of $C_2$~$C_{20}$, X for one of $C_1$~$C_5$ alkoxy groups and acyloxy groups, and m for an integer in the range of 1 to 3, providing that where m is 2 or more, at least one of the plurality of substituents $R^1$'s may be a radically polymerizable organic group of $C_2$~$C_{20}$ and the remainder may be an organic group containing no radically polymerizable group) and derivatives thereof; and a step of subjecting said radically polymerizable group to reaction of radical polymerization.

6. An electrostatic image developer according to claim 5, wherein the substituent $R^1$ in said general formula (I) is a member selected from the group consisting of:

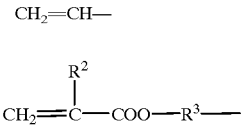

(wherein $R^2$ stands for one of hydrogen atom and methyl group, and $R^3$ for a $C_1$~$C_{10}$ alkylene group)

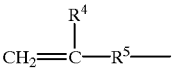

(wherein $R^4$ stands for one of hydrogen atoms and methyl group, and $R^5$ for one of phenylene group and $C_1$~$C_{10}$ alkylene groups).

7. An electrostatic image developer according to claim 1, wherein said organic-inorganic composite particles of (c) are obtained by the sequential steps of i) at a least partially hydrolyzing, in the presence of acid a hydrolyzable and condensable silicon compound selected from the group consisting of compounds represented by the formula (I):

$$R1_mSiX_{4-m} \quad (I)$$

wherein $R^1$ is a radically polymerizable organic groups of $C_2$ to $C_{20}$, X is a $C_1$ to $C_5$ alkoxy or acyloxy groups, and m is an integer in the range of 1 to 3, providing that where m is 2 or more, at least one of the plurality of $R^1$ substituents is a radically polymerizable organic group $C_2$ to $C_{20}$ and the remaining substituents are organic groups which are non-radically polymerizable, whereby there is formed at least one member of the group consisting of hydrolyzates, condensate of hydrolysates and hydrolyzate-condensate mixtures;

ii) polycondensing the product from said hydrolyzing step in the presence of a base; and iii) subjecting said radically polymerizable group to radical polymerization.

8. An elastrostatic image developer according to claim 7, wherein said substituent $R^1$ in said general formula (I) is at least one member selected from the group consisting of:

$$CH_2{=}CH-$$

$$CH_2{=}\overset{\overset{\displaystyle R^2}{|}}{C}-COO-R^3-$$

(wherein $R^2$ stands for one of hydrogen atoms and methyl group, and $R^3$ for a $C_1$~$C_{10}$ alkylene group) and $$CH_2{=}\overset{\overset{\displaystyle R^4}{|}}{C}-R^5-$$

(wherein $R^4$ stands for one of hydrogen atoms and methyl group, and $R^5$ for one of phenylene group and $C_1$~$C_{10}$ alkylene groups).

9. An electrostatic image developer according to claim 1, wherein (c) said organic-inorganic composite particles are obtained by a method comprising a step of at a degree of partial to whole, hydrolyzing a hydrolyzable and condensable silicon compound selected from the group consisting of compounds represented by the following general formula (Ib):

$$R^6{}_nSiX_{4-n} \quad (Ib)$$

(wherein $R^6$ stands for a $C_1$~$C_{20}$ organic group, X for one of $C_1$~$C_5$ alkoxy groups and acyloxy groups, and n for a number of 0 and 1, providing the plurality of X's may be identical with or different from one of a hydrolyzate, a condensate thereof and hydrolyzate- condensate mixtures; and a step of polycondensing the product from said hydrolyzing step in the presence of a base; and performing at least one of said hydrolyzing step and said polycondensing step in the presence of a polymer containing a group represented by the following general formula (II):

$$-CH_2-\underset{\underset{\displaystyle R^7{}_l}{|}}{SiY_{3-l}} \quad (II)$$

wherein $R^7$ stands for a $C_1$~$C_{20}$ organic group, Y for a hydrolyzable group, and l for a number of 0 and 1).

10. An electrostatic image developer according to claim 9, wherein said polymer is one member selected from the group consisting of polymers obtained by polymerizing a radically polymerizable group-containing, hydrolyzable and polymerizable silicon compound selected from the group consisting of compounds represented by the following general formula (III) and derivatives thereof, and polymers obtained by copolymerizing said silicon compound with a copolymerizable organic monomer $$R^8{}_pSiY_{4-p} \quad (III)$$

(wherein $R^8$ stands for a member selected from the group consisting of $$CH_2{=}CH- \quad (a)$$

$$CH_2{=}\overset{\overset{\displaystyle R^9}{|}}{C}-COO-R^{10}- \quad (b)$$

(wherein $R^9$ stands for one of hydrogen atoms and methyl group, and $R^{10}$ for a $C_1$~$C_{10}$ alkylene group) and $$CH_2{=}\overset{\overset{\displaystyle R^{11}}{|}}{C}-R^{12}- \quad (c)$$

(wherein $R^{11}$ stands for one of hydrogen atoms and methyl group, and $R^{12}$ for one of phenylene group and $C_1$~$C_{10}$ alkylene groups);

Y for a hydrolyzable group; and p for an integer in the range of 1 to 3; providing that where p is 2 or more, one of the plurality of substituents $R^8$'s is a radically polymerizable organic group of $C_2$~$C_{20}$ and the remainder is a $C_1$~$C_{20}$ organic group containing no radically polymerizable group).

* * * * *